US011459218B2

(12) United States Patent
Iwazawa et al.

(10) Patent No.: US 11,459,218 B2
(45) Date of Patent: Oct. 4, 2022

(54) CRANE AND CRANE POSTURE CHANGING METHOD

(71) Applicant: KOBELCO CONSTRUCTION MACHINERY CO., LTD., Hiroshima (JP)

(72) Inventors: Takahiro Iwazawa, Hyogo (JP); Dairo Matsui, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 124 days.

(21) Appl. No.: 17/253,232

(22) PCT Filed: Jun. 12, 2019

(86) PCT No.: PCT/JP2019/023280
§ 371 (c)(1),
(2) Date: Dec. 17, 2020

(87) PCT Pub. No.: WO2020/004038
PCT Pub. Date: Jan. 2, 2020

(65) Prior Publication Data

US 2021/0269287 A1 Sep. 2, 2021

(30) Foreign Application Priority Data

Jun. 28, 2018 (JP) ..... JP2018-122823
Jun. 28, 2018 (JP) ..... JP2018-122824

(51) Int. Cl.
*B66C 23/34* (2006.01)
*B66C 23/88* (2006.01)
*B66C 23/42* (2006.01)

(52) U.S. Cl.
CPC ..... *B66C 23/34* (2013.01); *B66C 23/42* (2013.01); *B66C 23/88* (2013.01);
(Continued)

(58) Field of Classification Search
CPC . B66C 23/34; B66C 23/88; B66C 2700/0364; B66C 2700/0392; B66C 2700/082; B66C 13/22
See application file for complete search history.

(56) References Cited

U.S. PATENT DOCUMENTS 3,794,184 A * 2/1974 Higgins ..... B66C 23/82 212/298
2012/0312767 A1 12/2012 Bohnacker et al.
(Continued)

FOREIGN PATENT DOCUMENTS

EP 1 553 043 A2 7/2005
GB 2 353 514 A 2/2001
(Continued)

OTHER PUBLICATIONS

JP 2019023130A Machine Translation (Year: 2019).*
(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A crane includes a crane main body, a boom, a jib, a boom driving unit, a jib driving unit, a manipulation unit, a drive control unit, a suspension device, a determination unit, and an operation regulating unit. The determination unit determines whether a jib boom angle condition is established or not. The operation regulating unit allows the crane to change a posture between a fall posture and a work posture according to a determination result of the determination unit.

13 Claims, 14 Drawing Sheets

(52) U.S. Cl.
CPC ..... *B66C 2700/0364* (2013.01); *B66C 2700/0392* (2013.01); *B66C 2700/082* (2013.01)

(56) References Cited

U.S. PATENT DOCUMENTS

| | | | | |
|---|---|---|---|---|
| 2017/0275142 | A1* | 9/2017 | Yoda | B66C 23/702 |
| 2018/0273355 | A1 | 9/2018 | Kitayama | |

FOREIGN PATENT DOCUMENTS

| | | | | | |
|---|---|---|---|---|---|
| JP | 2002-107143 | A | | 4/2002 | |
| JP | 2003-95584 | A | | 4/2003 | |
| JP | 2005-189211 | A | | 7/2005 | |
| JP | 2006-176242 | A | | 7/2006 | |
| JP | 2008-239327 | A | | 10/2008 | |
| JP | 2015-157696 | A | | 9/2015 | |
| JP | 2017-65914 | A | | 4/2017 | |
| JP | 2019023130 | A | * | 2/2019 | B66C 23/88 |

OTHER PUBLICATIONS

Extended European Search Report dated Oct. 1, 2021 in European Patent Application No. 19826571.2, 6 pages.
International Search Report dated Aug. 20, 2019 in PCT/JP2019/023280 filed Jun. 12, 2019, 2 pages.

* cited by examiner

UP
REAR
FRONT
DOWN
54,64
65
60
56
28
1(1B)
48
18S
22
53,63
18
50
44
52,62
58
47
57
21
46
25
92
16S
93
44
10
97
98
16D
26
60
16C
50
16
16B
90
16A
94
95
91
23
34
40
12
36
9A
32
42
5
96
2
4
13
9B
17

CRANE AND CRANE POSTURE CHANGING METHOD

TECHNICAL FIELD

The present invention relates to a crane and a posture changing method of the crane.

BACKGROUND ART

Conventionally, there is known a crane including a boom provided at a crane main body so as to be capable of being raised and lowered, and a jib coupled to a front end portion of the boom so as to be capable of being raised and lowered. The crane further includes a boom raising and lowering winch for taking up and drawing out a boom raising and lowering rope connected to the front end portion of the boom, and a jib raising and lowering winch for taking up and drawing out a jib raising and lowering rope connected to a front end portion of the jib. The crane also includes a hoisting-up rope suspended from the front end portion of the jib, and a hook connected to a front end portion of the hoisting-up rope. Taking up and drawing out of the hoisting-up rope enables a suspended load connected to the hook to be hoisted up or hoisted down.

For ordinary work, the crane is caused to take a posture (work posture) in which the boom extends upward and forward from the crane main body and the jib extends further upward and forward from the front end portion of the boom. On the other hand, Patent Literature 1 discloses, as a posture for assembling or disassembling such a crane, an overhanging posture in which the boom falls to a crane main body and the jib overhangs along the ground from the boom and an inside holding posture in which the boom falls and the jib is folded into the boom so that the jib approaches a lower surface of the falling boom.

CITATION LIST

Patent Literature

Patent Literature 1: Japanese Unexamined Patent Publication No. 2008-239327

For such a crane as described above to conduct work at a work posture safely, a work allowable range (a work allowable radius) is set according a weight of a suspended load. Then, for preventing the crane from overturning due to a moment applied to a crane main body by a weight of a suspended load, swinging of a boom and a jib is regulated (a moment limiting function) when a front end portion of the jib goes outside the work allowable range during work. On the other hand, for changing a posture of such a crane between the work posture and the overhanging posture or the inside holding posture, it is necessary to bring the front end portion of the jib down to the ground or bring the front end portion of the jib away from the ground while having the boom and the jib falling to a region exceeding the work allowable range. Therefore, it is necessary to cancel the above-described moment limiting function when the boom and the jib fall or rise. However, in a case of conducting falling work or rising work of the boom and the jib with the moment limiting function cancelled, the crane might overturn forward because the crane main body cannot support the boom and the jib depending on a posture of the crane. Accordingly, a worker needs to conduct falling work or rising work of the boom and the jib while carefully preventing the crane from overturning. As a result, changing a posture of the crane between the work posture and the fall posture required a lot of time and worker's attention.

An object of the present invention is to prevent a crane from overturning, the crane being provided with a raising and lowering body including a boom and a jib connected to a front end portion of the boom, while reducing a worker's load in posture changing work at the time of cancelling a moment limiting function to change a posture of the raising and lowering body.

SUMMARY OF INVENTION

As described in the foregoing, by cancelling a moment limiting function operating during ordinary work of a crane, it is possible to cause a boom and a jib to fall to the ground or the boom and the jib to rise from the ground. However, it is necessary to take into consideration safety of the crane also at the time of such fall or rise. Focusing on a jib offset angle as an angle formed by a boom and a jib at the time of fall or rise, the inventor of the present invention has found that a posture of the crane can be changed between a work posture and a fall posture without overturning of the crane even when the moment limiting function is cancelled as long as the jib offset angle satisfies a predetermined condition.

From this point of view, the present invention provides a crane including: a crane main body; a boom supported by the crane main body so as to be swingable around a horizontal first rotation axis; a jib having a base end portion supported at a front end portion of the boom so as to be swingable around a second rotation axis parallel to the first rotation axis and a front end portion on a side opposite to the base end portion; a boom driving unit which causes the boom to swing in a rise direction and a fall direction around the first rotation axis; a jib driving unit which causes the jib to swing in the rise direction and the fall direction around the second rotation axis; a manipulation unit which accepts manipulation for driving the boom and the jib; a drive control unit which outputs a drive signal for controlling the boom driving unit and the jib driving unit according to the manipulation input to the manipulation unit; a hoisting device which is suspended from the front end portion of the jib and connected to a suspended load; an angle condition determination unit; and an operation regulating unit. The angle condition determination unit determines whether a jib boom angle condition is established or not, the jib boom angle condition being established in a case where a jib offset angle as an angle defined by an extension of a center line of the boom and a center line of the jib when viewed from a direction parallel to the second rotation axis is larger than a threshold value angle formed of an acute angle set in advance. The operation regulating unit regulates swinging of the boom and the jib according to a mode set in advance. The operation regulating unit has an ordinary work mode and a self-erecting and falling mode, and regulates, in the ordinary work mode, swinging of the boom and the jib so that the front end portion of the jib is included in a work allowable range at a work posture of the crane at which the boom rises with respect to the crane main body and the jib rises with respect to the boom, the work allowable range being set according to a weight of the suspended load, and allows, in the self-erecting and failing mode, the front end portion of the jib to enter an outside of the work allowable range irrespective of the weight of the suspended load, as well as allowing the crane to change a posture between a fall posture, at which the boom and the jib fall forward of the work posture and the front end portion of the jib lands on the ground, and the work posture according to a determination result of the angle condition determination unit.

DESCRIPTION OF EMBODIMENT

Figure 1:
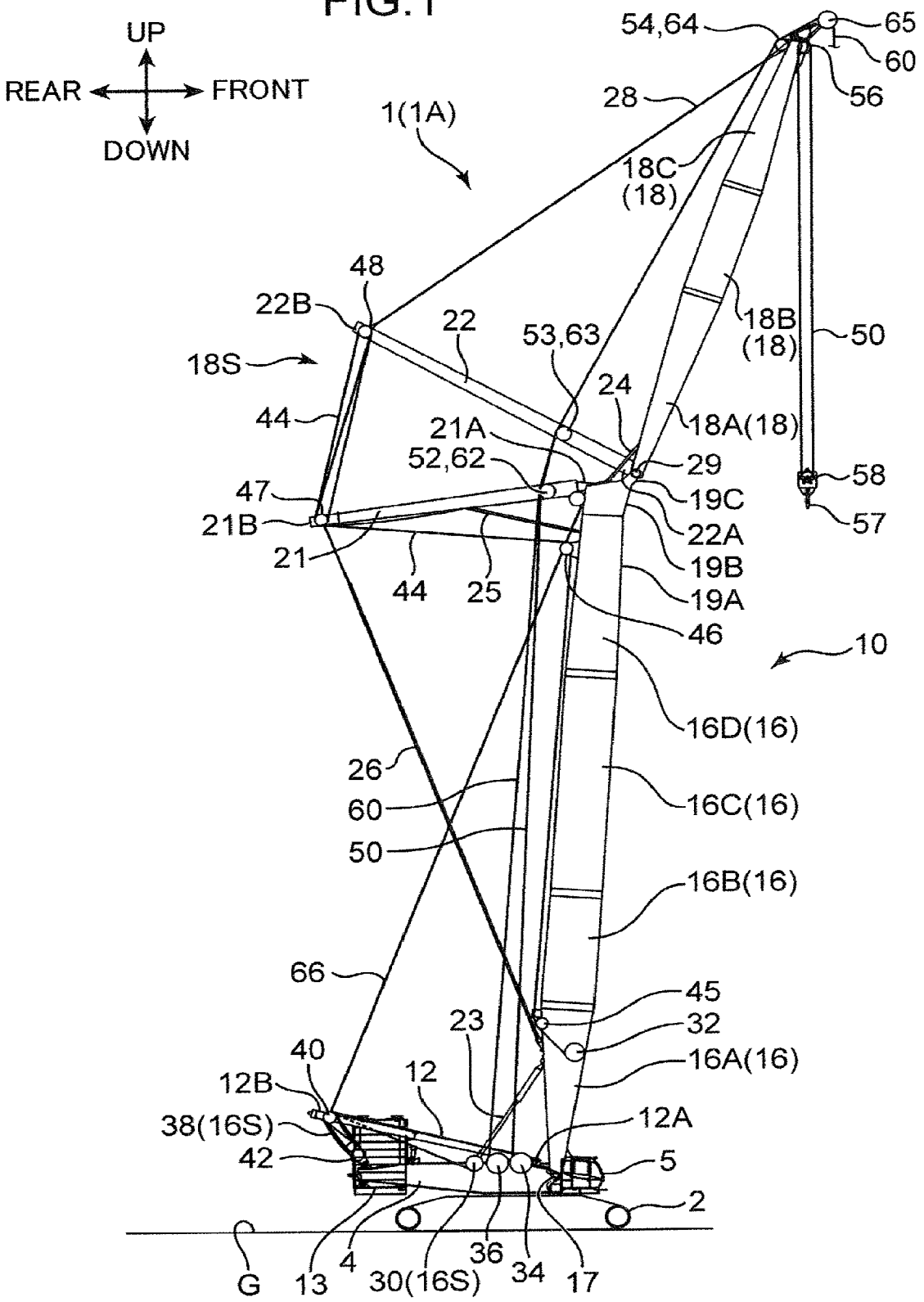
FIG. 1 is a side view schematically showing a first mode of a crane according to one embodiment of the present invention.
Figure 2:
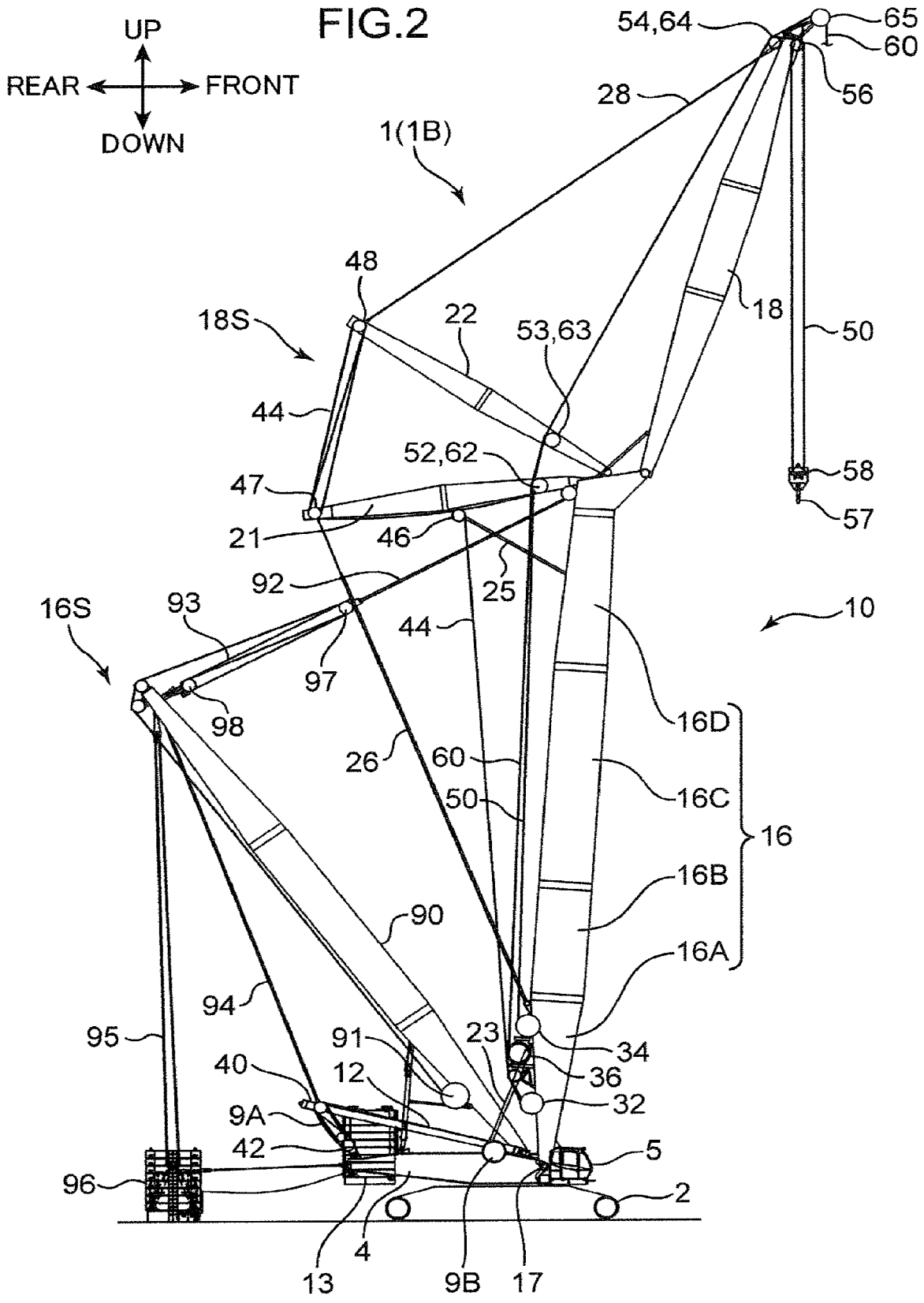
FIG. 2 is a side view schematically showing a second mode of the crane according to one embodiment of the present invention.

In the following, a crane 1 according to one embodiment of the present invention will be described with reference to the drawings. FIG. 1 is a side view schematically showing a first mode (a crane 1A) of the crane 1 according to the present embodiment. The first mode is also referred to as an STD-LF mode (a standard luffing mode). FIG. 2 is a side view schematically showing a second mode (a crane 1B) of the crane 1 according to the present embodiment. The second mode is also referred to as an SHL-LF mode (a super-heavy lift luffing mode). While sharing a part of members of the crane 1A in the STD-LF mode shown in FIG. 1, by adding or changing the other members, the crane 1 can be made into the crane 1B in the mode shown in FIG. 2.

The crane 1 according to the present embodiment includes a self-propellable lower travelling body 2, an upper slewing body 4 as a crane main body mounted on the lower travelling body 2 so as to be slewable around a vertical axis, a cab 5 (a driver's room) provided at a front end portion of the upper slewing body 4 and allowing a worker manipulating the crane 1 to board, an attachment 10 (a raising and lowering body) attached to a front portion of the upper slewing body 4 for conducting hoisting work, a mast 12 attached, on a rear side of the attachment 10, to the upper slewing body 4, and counterweights 13 mounted on a rear side portion of the upper slewing body 4 in order to keep balance of the crane 1 and improve stability. Front, rear and right, left are defined based on the upper slewing body 4 slewing with respect to the lower travelling body 2. A direction in which a boom 16 to be described later of the attachment 10 falls is determined to be the front, and a direction opposite to the front is determined to be the rear. Right and left are determined on the basis of the front according to this definition.

The attachment 10 has the boom 16, a jib 18, a rear strut 21, a front strut 22, a pair of right and left boom backstops 23, a pair of right and left jib backstops 24, a pair of right and left strut backstops 25, a pair of right and left strut guy links 26, a pair of right and left jib guy links 28, a main hook 57, and a subsidiary hook (not shown).

The boom 16 is attached to the front portion of the upper slewing body 4 so as to be swingable in a rise direction and a fall direction around a horizontal axis (a first rotation axis). The boom 16 is of a so-called lattice type. The boom 16 can be disassembled into a plurality of parts in its longitudinal direction. Specifically, the boom 16 has a lower boom 16A, one or a plurality (two in the illustration) of intermediate booms 16B and 16C, and an upper boom 16D, and can be disassembled into these lower boom 16A, intermediate booms 16B and 16C, and upper boom 16D.

The lower boom 16A is a part including a base end portion of the boom 16 and is coupled to the front portion of the upper slewing body 4 so as to be swingable around the axis (the first rotation axis) extending in a right-left direction of the upper slewing body 4. Specifically, a base end portion of the lower boom 16A corresponding to the base end portion of the boom 16 is coupled to the front portion of the upper slewing body 4 by a boom foot pin 17 extending in the right-left direction, and the lower boom 16A is swingable centered around the boom foot pin 17. The pair of right and left boom backstops 23 is interposed between the lower boom 16A and the upper stewing body 4. Specifically, the pair of right and left boom backstops 23 is provided on the upper slewing body 4, and comes into contact with both right and left side portions of the lower boom 16A when the boom 16 takes a rise posture as shown in FIG. 1. This contact regulates tilting of the boom 16 to the rear side due to strong wind or the like.

The intermediate booms 16B and 16C are detachably added to a front end side of the lower boom 16A in this order.

The upper boom 16D is detachably added to a front end side of the intermediate boom 16C. The upper boom 16D has an upper boom main body 19A with a lattice structure connected to the intermediate boom 16C, and a boom head 19B connected to a tip of the upper boom main body 19A. The boom head 19B corresponds to a front end portion of the boom 16.

The jib 18 is of a lattice type and is attached to the front end portion (the boom head 19B) of the boom 16 so as to be swingable in the rise direction and the fall direction around an axis extending in the right-left direction (a second rotation axis parallel to the first rotation axis). Specifically, the jib 18 has a base end portion, which is one end portion of the jib 18 in a longitudinal direction and attached to the boom head 19B so as to be swingable around the axis extending in the right-left direction, and a front end portion which is an end portion opposite to the base end portion. The jib 18 can also be disassembled into a plurality of parts in the longitudinal direction. Specifically, the jib 18 has a lower jib 18A, one or a plurality (one in the illustration) of intermediate jibs 18B, and an upper jib 18C, and can be disassembled into these lower jib 18A, intermediate jib 18B, and upper jib 18C.

The lower jib 18A, which is a part including the base end portion of the jib 18, can be separated from the intermediate jib 18B and the upper jib 18C, the jibs being closer to the side of the front end portion of the jib 18 than the lower jib 18A is, by disassembling the jib 18 in the longitudinal direction. The lower jib 18A is coupled to the boom head 19B so as to be swingable around the axis extending in the right-left direction. Specifically, a base end portion of the lower jib 18A corresponding to the base end portion of the jib 18 is coupled to the boom head 19B by a jib foot pin 29 extending in the right-left direction, so that the lower jib 18A is swingable centered around the jib foot pin 29 with respect to the boom 16.

In more detail, the boom head 19B has a jib attachment portion 19C located at a frontmost portion of the boom head 19B when the boom 16 rises as shown in FIG. 1. The jib attachment portion 19C is provided with a pin hole and the base end portion of the lower jib 18A is also provided with a pin hole. Then, with the pin hole of the jib attachment portion 19C and the pin hole of the base end portion of the lower jib 18A matching with each other, the jib foot pin 29 is inserted into these pin holes so as to extend in the right-left direction, resulting in coupling the base end portion of the lower jib 18A to the jib attachment portion 19C via the jib foot pin 29.

The lower jib 18A is also detachable from the jib attachment portion 19C of the boom head 19B. In other words, the lower jib 18A can be separated from the jib attachment portion 19C by pulling out the jib foot pin 29 from the pin hole.

Between the lower jib 18A and the boom head 19B, the pair of right and left jib backstops 24 is interposed. The pair of right and left jib backstops 24 is attached to the boom head 19B, and comes into contact with both right and left side portions of the lower jib 18A when the jib 18 takes a rise posture as shown in FIG. 1. This contact regulates tilting of the jib 18 to the rear side due to strong wind or the like.

The intermediate jib 18B is detachably added to a front end side of the lower jib 18A. Additionally, the upper jib 18C is detachably added to a front end side of the intermediate jib 18B. A front end portion of the upper jib 18C corresponds to the front end portion of the jib 18.

The rear strut 21 is attached to the boom head 19B so as to be swingable around the axis extending in the right-left direction. The rear strut 21 has a rear strut base end portion 21A, which is one end portion of the rear strut in a longitudinal direction and attached to the boom head 19B, and a rear strut front end portion 21B which is an end portion opposite to the rear strut base end portion 21A.

The rear strut 21 is held in an overhanging posture in a direction in which the boom 16 rises from the boom head 19B (leftward in FIG. 1). As means for holding this posture, the pair of right and left strut backstops 25 and the pair of right and left strut guy links 26 are interposed between the rear strut 21 and the boom 16. The strut backstops 25 are interposed between the upper boom 16D and an intermediate portion of the rear strut 21 to support the rear strut 21 from below. The strut guy links 26 stretch so as to link the rear strut front end portion 21B and the lower boom 16A, and a tension of the strut guy link regulates the position of the rear strut 21.

The front strut 22 is attached to the lower jib 18A so as to be swingable around the axis extending in the right-left direction. The front strut 22 has a front strut base end portion 22A, which is one end portion of the front strut in a longitudinal direction and attached to the base end portion of the jib 18, and a front strut front end portion 22B which is an end portion opposite to the front strut base end portion 22A.

Between the front strut front end portion 22B and the front end portion of the jib 18, the pair of right and left jib guy links 28 is stretched so as to link these portions. Stretching the jib guy links 28 regulates an angle between the front strut 22 and the jib 18 so as not to be increased more. In this state, pulling the front strut front end portion 22B to the rear strut front end portion 21B side will cause the front strut 22 and the jib 18 to swing to the rear side centered around the jib foot pin 29 while keeping the angle between the front strut 22 and the jib 18, in other words, keeping a relative positional relationship between the front strut 22 and the jib 18.

The rear strut 21 described above is arranged more rearward than the front strut 22 is. Specifically, the rear strut 21 is attached to the boom head 19B so as to be swingable around the axis extending in the right-left direction, the rear strut being attached at a position rearward of an attachment position of the jib 18 to the boom head 19B and rearward of an attachment position of the front strut 22 to the lower jib 18A.

The mast 12 has a mast base end portion 12A, which is one end portion of the mast in a longitudinal direction and attached to the upper stewing body 4, and a mast front end portion 12B which is an end portion opposite to the mast base end portion 12A. The mast base end portion 12A is coupled to the upper slewing body 4 so as to be swingable around the axis extending in the right-left direction. The mast front end portion 12B is coupled to the boom head 19B via a pair of right and left boom guy lines 66. This coupling causes swinging of the mast 12 and swinging of the boom 16 to be associated with each other.

The main hook 57 and the subsidiary hook (not shown) are hung from the front end portion of the jib 18 to hang a suspended load.

The crane 1 (1A) of the present embodiment further includes a boom raising and lowering winch 30 for raising and lowering the boom 16, a jib raising and lowering winch 32 for swinging the jib 18 with its base end portion as a supporting point and raising and lowering the jib 18, and a main hoist winch 34 and a subsidiary hoist winch 36 for hoisting up and hoisting down a suspended load. The boom raising and lowering winch 30, the subsidiary hoist winch 36, and the main hoist winch 34 are disposed on the upper slewing body 4 from the rear to the front in this order. The jib raising and lowering winch 32 is provided in the lower boom 16A.

The boom raising and lowering winch 30 takes up and draws out a boom raising and lowering rope 38. Then, the boom raising and lowering rope 38 is routed so that the mast 12 swings by this take-up and draw-out. Specifically, the mast front end portion 12B is provided with a sheave block 40 formed of a plurality of sheaves arranged so as to be aligned in the right-left direction, and a rear end portion of the upper slewing body 4 is provided with a sheave block 42 formed of a plurality of sheaves similarly arranged so as to be aligned in the right-left direction. The boom raising and lowering rope 38 drawn out from the boom raising and lowering winch 30 is extended between the sheave blocks 40 and 42. Then, take-up or draw-out of the boom raising and lowering rope 38 by the boom raising and lowering winch 30 changes a distance between both the sheave blocks 40 and 42, resulting in causing the mast 12 and the boom 16 in association with the mast 12 to swing to rise and fall. In other words with respect to the boom raising and lowering rope 38, the boom raising and lowering rope 38 is indirectly connected to the front end portion of the boom 16 via the mast 12 and the boom guy lines 66. The boom raising and lowering winch 30 and the boom raising and lowering rope 38 form a boom driving unit 16S of the present invention. The boom driving unit 16S causes the boom 16 to swing around the boom foot pin 17 in the rise direction and the fall direction.

The jib raising and lowering winch 32 takes up and draws out a jib raising and lowering rope 44. Then, the jib raising and lowering rope 44 is routed so that the front strut 22 swings by this take-up and draw-out.

Specifically, the lower boom 16A is provided with a jib raising and lowering first guide sheave 45, and the upper boom 16D is provided with a jib raising and lowering second guide sheave 46. Additionally, the rear strut front end portion 21B is provided with a sheave block 47 formed of a plurality of sheaves arranged so as to be aligned in the right-left direction, and the front strut front end portion 22B is provided with a sheave block 48 formed of a plurality of sheaves similarly arranged so as to be aligned in the right-left direction. Then, the jib raising and lowering rope 44 drawn out from the jib raising and lowering winch 32 is sequentially hung upon the jib raising and lowering first guide sheave 45 and the jib raising and lowering second guide sheave 46 and also wound around the sheave block 48 of the front strut front end portion 22B and the sheave block 47 of the rear strut front end portion 21B. Accordingly, take-up or draw-out of the jib raising and lowering rope 44 by the jib raising and lowering winch 32 changes a distance between the sheave blocks 47 and 48, resulting in causing the front strut 22 and the jib 18 in association with the front strut to swing to rise and fall.

Specifically, while by taking up the jib raising and lowering rope 44, the jib raising and lowering winch 32 causes the front strut 22 to swing in a direction in which the front strut front end portion 22B comes close to the rear strut front end portion 21B and to swing the jib 18 in a direction for rise, by drawing out the jib raising and lowering rope 44, the jib raising and lowering winch causes the front strut 22 to swing in a direction in which the front strut front end portion 22B goes away from the rear strut front end portion 21B and to swing the jib 18 in a direction for fall. In other words with respect to the jib raising and lowering rope 44, the jib raising and lowering rope 44 is indirectly connected to the front end portion of the jib 18 via the front strut 22 and the jib guy links 28. Additionally, the jib raising and lowering winch 32, the jib raising and lowering rope 44, the rear strut 21, the front strut 22, and the jib guy links 28 form a jib driving unit 18S of the present invention. The jib driving unit 18S causes the jib 18 to swing around the jib foot pin 29 in both the rise direction and the fall direction.

The main hoist winch 34 conducts hoist-up and hoist-down of a suspended load by a main hoist rope 50. Specifically, a first main hoist guide sheave 52 is provided at a portion near a base end of the rear strut 21 so as to be rotatable around the axis extending in the right-left direction, and a second main hoist guide sheave 53 is provided at a portion near a base end of the front strut 22 so as to be rotatable around the axis extending in the right-left direction. Additionally, the front end portion of the jib 18 is provided with a third main hoist guide sheave 54 so as to be rotatable around the axis extending in the right-left direction, and also a main hoist sheave block formed of a plurality of main hoist point sheaves 56 arranged so as to align in the right-left direction at a position adjacent to the third main hoist guide sheave 54. The main hoist rope 50 drawn out from the main hoist winch 34 is sequentially hung upon the first, second, and third main hoist guide sheaves 52, 53, and 54, and is stretched over the main hoist point sheave 56 of the main hoist sheave block and over a sheave 58 of a sheave block provided at the main hook 57 as a suspension tool. Accordingly, by conducting take-up or draw-out of the main hoist rope 50 by the main hoist winch 34, a distance between the main hoist point sheave 56 and the sheave 58 of the main hook 57 is changed, resulting in hoisting up and hoisting down the main hook 57 coupled to the main hoist rope 50 suspended from a tip of the jib 18. The main hook 57 forms a suspension device of the present invention. The main hook 57 is suspended from the front end portion of the jib 18 and connected to a suspended load.

The subsidiary hoist winch 36 conducts hoist-up and hoist-down of a suspended load by a subsidiary hoist rope 60. For this subsidiary hoist, the crane 1 includes a first subsidiary hoist guide sheave 62, a second subsidiary hoist guide sheave 63, a third subsidiary hoist guide sheave 64, and a subsidiary sheave 65 in addition to the subsidiary hoist winch 36. Functions of these members related the subsidiary hoist are the same as those of the members related the main hoist described above.

Figure 8:
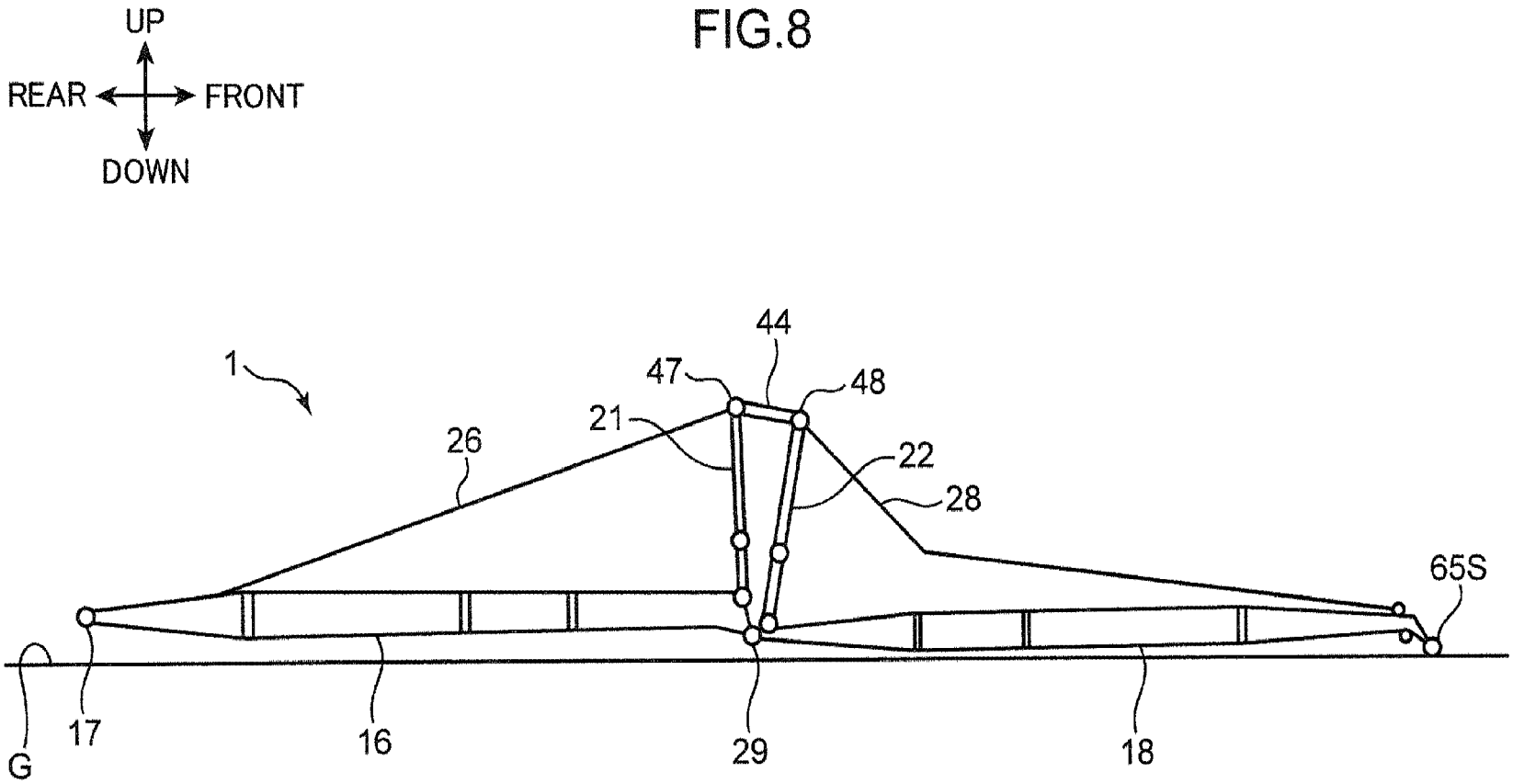
FIG. 8 is a step view showing self-erecting and fall operation of the crane according to one embodiment of the present invention.
Figure 9:
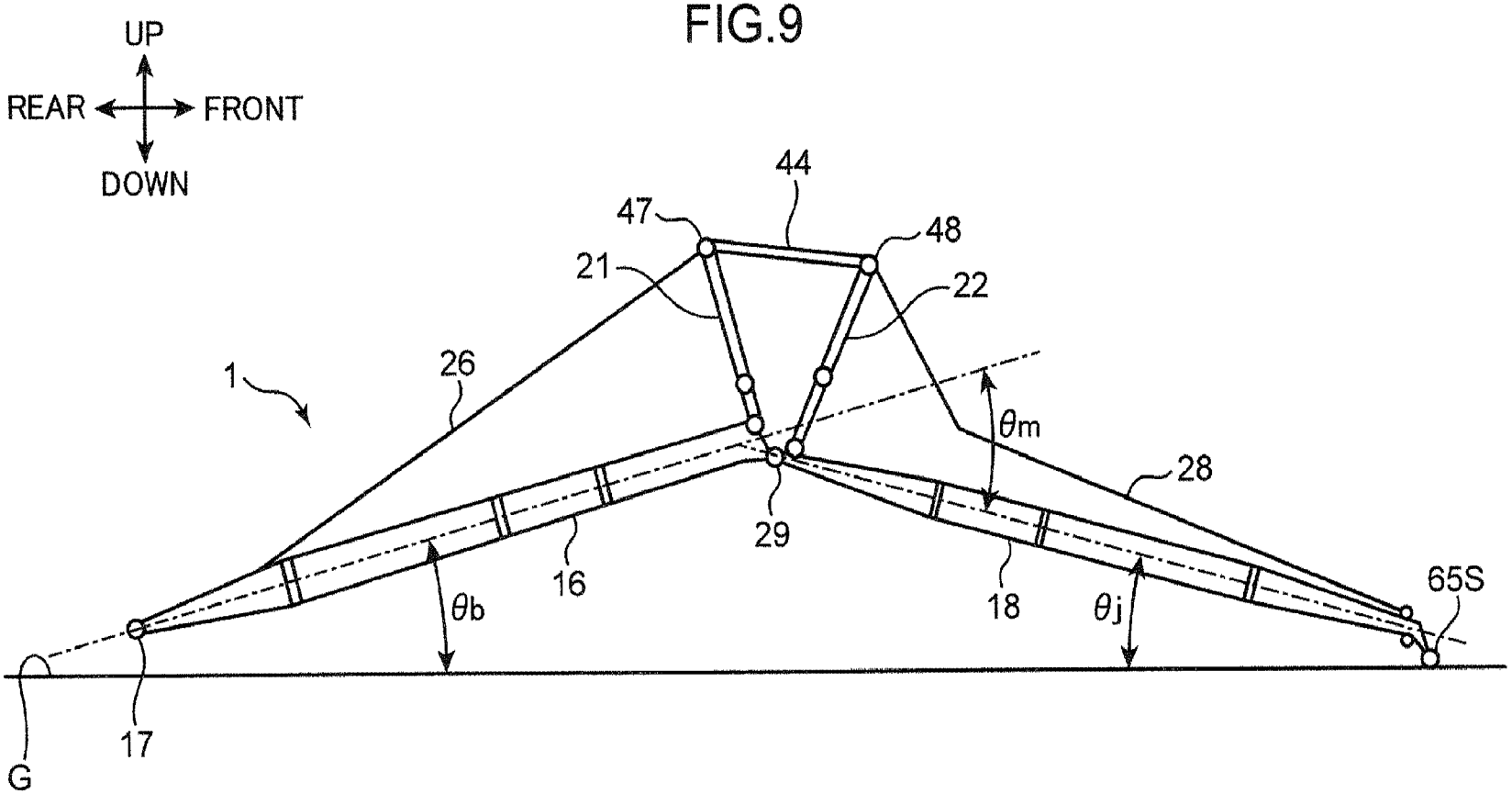
FIG. 9 is a step view showing the self-erecting and fall operation of the crane according to one embodiment of the present invention.

Further, the crane 1 includes a pair of right and left wheels 65S (FIG. 8 and FIG. 9). The wheels 65S are arranged on the same axis at the front end portion of the jib 18 as the subsidiary sheave 65. An outer diameter of the wheel 65S is set to be larger than an outer diameter of the subsidiary sheave 65. The wheel 65S rolls on the ground in a state where the boom 16 and the jib 18 of the crane 1 fall on the ground. As a result, the boom 16 and the jib 18 can move with ease at the time of work for assembling and dissembling the crane 1.

Next, description will be made of the crane 1B (the crane 1) in the SHL-LF mode shown in in FIG. 2. The crane 1B mainly differs from the crane 1A in that the crane 1B includes a lattice mast 90, a boom raising and lowering winch 91, a guy link 92, a boom raising and lowering rope 93, a guy link 94, a weight guy link 95, and palette weights 96. Therefore, the following description will be made mainly of the different points, and no description will be made of common points.

The lattice mast 90 is swingably supported, by the upper slewing body 4, behind the boom 16 and between the mast 12 and the boom 16. When the crane 1B is used, the lattice mast 90 is fixed, at a position forming a predetermined ground angle, to the upper slewing body 4 to become a strut for swinging of the boom 16. The boom raising and lowering winch 91 is arranged on a base end side of the lattice mast 90 to conduct take-up and draw-out of the boom raising and lowering rope 93. The guy link 92 and the boom raising and lowering rope 93 are arranged so as to connect a tip of the boom 16 and a tip of the lattice mast 90. In detail, the guy link 92 extends from the tip of the boom 16 toward the tip of the lattice mast 90. After being drawn out from the boom raising and lowering winch 91, the boom raising and lowering rope 93 is wound a plurality of times between a sheave block 97 provided at a tip of the guy link 92 and a sheave block 98 provided at the tip of the lattice mast 90. The guy link 94 couples a tip of the mast 12 and the tip of the lattice mast 90. The weight guy link 95 couples the tip of the lattice mast 90 and the palette weight 96. The palette weights 96, which are arranged at intervals on the rear side of the upper slewing body 4, keep balance of the crane 1B including the lattice mast 90. In the crane 1B, a mast raising and lowering rope 9A is wound between the tip of the mast 12 and the upper slewing body 4. On a base end side of the mast 12, a mast raising and lowering winch 9B is provided. The mast 12 and the lattice mast 90 are integrally swung by taking up and drawing out the mast raising and lowering rope 9A by the mast raising and lowering winch 9B.

In the crane 1B, take-up or draw-out of the boom raising and lowering rope 93 by the boom raising and lowering winch 91 provided at a base end portion of the lattice mast 90 changes a distance between the sheave block 97 and the sheave block 98, resulting in causing the boom 16 to swing relatively with respect to the lattice mast 90. As a result, swinging (raising and lowering) of the boom 16 is realized. Although, in the crane 1B, the main hoist winch 34 and the subsidiary hoist winch 36 are fixed to the lower boom 16A of the boom 16, arrangement of these winches is not limited to the modes shown in FIG. 1 and FIG. 2. In the crane 1B, the lattice mast 90, the boom raising and lowering winch 91, the guy link 92, and the boom raising and lowering rope 93 form the boom driving unit of the present invention.

In the present embodiment, as in the crane 1 (the cranes 1A and 1B), the similarly long jib 18 is connected to the front end portion of the long boom 16. Then, overturning of the crane 1 is prevented when self-erecting operation or fall operation of such a crane 1 is conducted.

Figure 3:
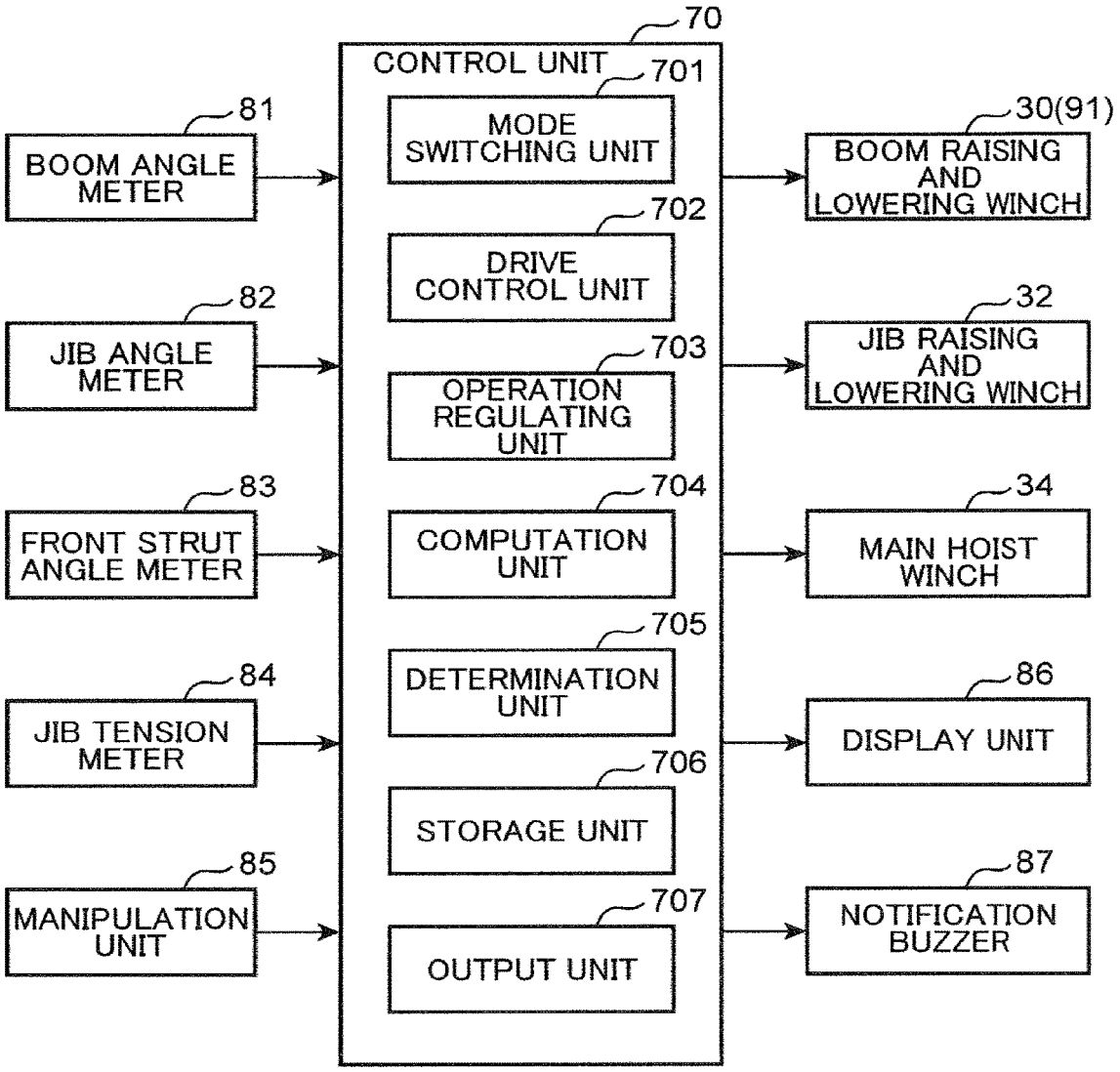
FIG. 3 is an electrical block diagram of a configuration for controlling the crane according to one embodiment of the present invention.

FIG. 3 is an electrical block diagram of a configuration for controlling the crane 1 (1A and 1B) according to the present embodiment. The crane 1 further includes a control unit 70 which centrally controls operation of the crane 1, a boom angle meter 81 (a boom angle detection unit), a jib angle meter 82 (a jib angle detection unit), a front strut angle meter 83, a jib tension meter 84, a manipulation unit 85 (an input unit), a display unit 86, and a notification buzzer 87.

The control unit 70 is configured with a CPU (Central Processing Unit), a ROM (Read Only Memory) which stores a control program, a RAM (Random Access Memory) for use as a work region of the CPU, and the like. There are electrically connected to the control unit 70, the boom angle meter 81, the jib angle meter 82, the front strut angle meter 83, the jib tension meter 84, the manipulation unit 85, the boom raising and lowering winch 30 (the boom raising and lowering winch 91), the jib raising and lowering winch 32, the main hoist winch 34, and the like. The control unit 70 may be electrically connected to a hydraulic circuit (e.g. a control valve) for driving a hydraulic motor (not shown) and connected to these winches.

The boom angle meter 81, which is provided at the base end portion of the boom 16, detects a ground angle θb of the boom 16 (see FIG. 9), and also outputs a signal according to the ground angle θb and inputs the signal to the control unit 70. Similarly, the jib angle meter 82, which is provided at the front end portion of the jib 18, detects a ground angle θj of the jib 18 (see FIG. 5), and also outputs a signal according to the ground angle θj and inputs the signal to the control unit 70. Further, the front strut angle meter 83, which is provided at a base end portion of the front strut 22, detects a ground angle of the front strut 22 (not shown), and also outputs a signal according to the ground angle and inputs the signal to the control unit 70.

The jib tension meter 84 is provided at the front end portion of the jib 18 and partly sandwiches a front end portion of the jib guy link 28. The jib tension meter 84 detects a tension Tm of the jib guy link 28 extending between a front end portion of the front strut 22 and the front end portion of the jib 18.

The manipulation unit 85 is arranged inside the cab 5 and accepts various kinds of manipulations by a worker. In the present embodiment, the manipulation unit 85 includes a plurality of manipulation levers and a touch panel type or a button type input unit. The plurality of manipulation levers accepts travelling operation of the lower travelling body 2, slewing operation of the upper slewing body 4, and manipulation for driving the boom raising and lowering winch 30, the jib raising and lowering winch 32, the main hoist winch 34, and the subsidiary hoist winch 36, respectively. The input unit accepts each manipulation information and parameter numerical values of the crane 1. As one example, the input unit accepts length information about a length of the boom 16 and a length of the jib 18, as well as accepting weight information about weights of the counterweight 13 and the palette weight 96.

The display unit 86 is arranged inside the cab 5 similarly to the manipulation unit 85. The display unit 86 displays various kinds of work information of the crane 1. The notification buzzer 87, which is arranged inside the cab 5 and outside the cab 5, notifies predetermined warning information to a worker in the cab 5 or a worker in the surroundings of the crane 1.

By executing a control program stored in the ROM by the CPU, the control unit 70 functions so as to include a mode switching unit 701, a drive control unit 702, an operation regulating unit 703, a computation unit 704, a determination unit 705 (an angle condition determination unit and a jib contact state determination unit), a storage unit 706, and an information output unit 707.

Figure 4:
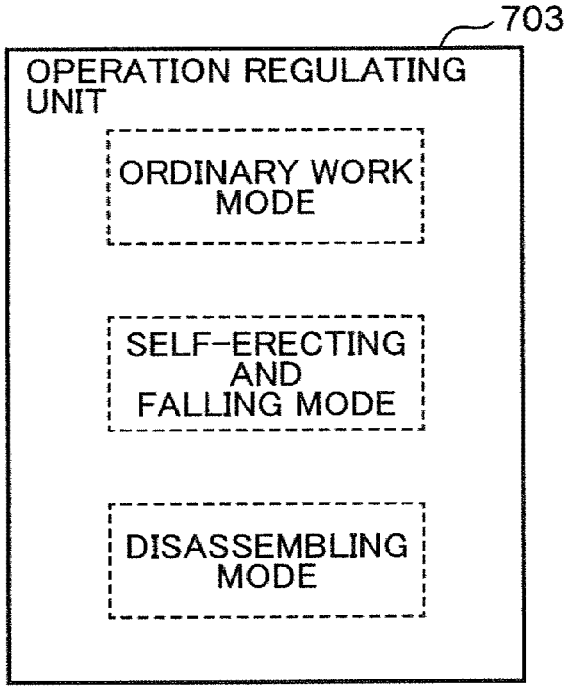
FIG. 4 is a schematic diagram showing each mode of an operation regulating unit of FIG. 3.

The mode switching unit 701 switches a plurality of modes of the operation regulating unit 703. FIG. 4 is a schematic diagram showing each mode of the operation regulating unit 703 shown in FIG. 3. The operation regulating unit 703 has an ordinary work mode, a self-erecting and falling mode (also referred to as a fall allowed mode or a self-erecting allowed mode), and a disassembling mode.

The ordinary work mode is a mode allowing the crane 1 at a work posture to conduct ordinary work, the work posture of the crane 1 being a posture having the boom 16 rising with respect to the upper slewing body 4 and the jib 18 rising with respect to the boom 16.

The self-erecting and falling mode is a mode allowing the self-erecting operation and the fall operation of the crane 1. Specifically, the self-erecting and falling mode is a mode allowing the crane 1 to change a posture from the work posture until reaching a fall posture at which the boom 16 and the jib 18 fall forward of the work posture and the front end portion of the jib 18 lands on the ground. Further, the self-erecting and falling mode is also a mode allowing the crane 1 to change a posture from the fall posture to the work posture (self-erect).

The disassembling mode is a mode allowing all operations executable in the self-erecting and falling mode, as well as allowing other operations not allowed in the self-erecting and falling mode. As one example, in the disassembling mode, detaching of the jib 18 from the boom 16 is allowed and detaching of the boom 16 from the upper slewing body 4 is allowed. Also in the disassembling mode, attaching of the jib 18 to the boom 16 is allowed and attaching of the boom 16 to the upper slewing body 4 is allowed.

Mode switching of the operation regulating unit 703 by the mode switching unit 701 is conducted according to an instruction input from the manipulation unit 85 by a worker. Additionally, when a predetermined condition is satisfied as will be described later, the mode of the operation regulating unit 703 is switched by the mode switching unit 701.

The drive control unit 702 controls driving of the driving members of the crane 1, including the boom raising and lowering winch 30 (the boom raising and lowering winch 91), the jib raising and lowering winch 32, the main hoist winch 34, and the like, according to manipulation input to the manipulation unit 85. Specifically, the drive control unit 702 outputs a drive instruction signal (a drive signal) to a hydraulic circuit connected to an electric motor or a hydraulic motor for causing each winch provided in the crane 1 to rotate.

The operation regulating unit 703 regulates swinging of the boom 16 and the jib 18 according to a mode set in advance. In particular, the operation regulating unit 703 has a function, as a safety device, of regulating these operations in a case where a predetermined condition is satisfied when the crane 1 conducts the fall operation or the self-erecting operation. Specifically, the operation regulating unit 703 regulates swinging of the boom 16 and the jib 18 so that, at the work posture of the crane 1, the front end portion of the jib 18 is included in a work allowable range set according to a weight of the suspended load (a moment limiting function). The operation regulating unit 703 also allows the front end portion of the jib 18 to enter the outside of the work allowable range irrespective of a weight of the suspended load when the fall operation of the crane is conducted during execution of the self-erecting and falling mode, as well as allowing the crane 1 to change a posture from the work posture to the fall posture. When a jib boom angle condition is established during the fall operation of the crane 1, the condition being established in a case where a jib offset angle θm (see FIG. 9) as an angle defined by an extension of a center line of the boom 16 and a center line of the jib 18 when viewed from the direction parallel to the rotation axis of the boom 16 (the right-left direction) is larger than an offset limit angle θs formed of an acute angle set in advance, the operation regulating unit 703 allows rise operation and fall operation of the boom 16 and rise operation and fall operation of the jib 18. By contrast, in a case where during the fall operation of the crane 1, the jib boom angle condition is not established, the operation regulating unit 703 outputs a rise and fall regulation signal for regulating rise and fall operation of the boom 16 and the rise operation of the jib 18. In this case, the fall operation of the jib 18 is allowed.

In a case where when the self-erecting operation of the crane 1 is conducted during execution of the self-erecting and falling mode, if the determination unit 705 determines that the above-described jib boom angle condition is not established and a contact determination condition to be described later is not satisfied, the operation regulating unit 703 outputs the rise and fall regulation signal for regulating the rise operation and the fall operation of the boom 16 and the rise operation of the jib 18. The above-described regulating operation executed by the operation regulating unit 703 will be detailed later.

The computation unit 704 (an angle decision unit) executes computation processing in various kinds of flows executed by the control unit 70. The computation unit 704 computes and decides the above-described jib offset angle θm from the ground angle θb of the boom 16 detected by the boom angle meter 81 and the ground angle θj of the jib 18 detected by the jib angle meter 82.

The storage unit 706 is designed to store the offset limit angle θs in advance and be capable of outputting the offset limit angle θs. In the present embodiment, the storage unit 706 stores a plurality of the offset limit angles θs according to a combination of the length of the jib 18, the length of the boom 16, and a weight of the counterweight 13 (the palette weight 96), and outputs a predetermined offset limit angle θs from among the plurality of offset limit angles θs according to the length information and the weight information input to the manipulation unit 85. The storage unit 706 also stores the offset limit angles θs of the STD-LF specification shown in FIG. 1 and the SHL-LF specification shown in FIG. 2 in a table format. The storage unit 706 may store and output the offset limit angle θs according to the length information of the boom 16 and the jib 18 irrespective of the weight information of the counterweight 13 (the palette weight 96).

The determination unit 705 executes determination processing in the various kinds of flows executed by the control unit 70. In particular, the determination unit 705 determines that the jib boom angle condition is established in a case where the jib offset angle θm decided by the computation unit 704 is larger than the offset limit angle θs output from the storage unit 706, and determines that the jib boom angle condition is not established in a case where the jib offset angle θm is smaller than the offset limit angle θs. Further, the determination unit 705 also has a function as the jib contact state determination unit which determines whether or not a state of the jib satisfies a predetermined contact determination condition. The contact determination condition is a predetermined condition for determining whether or not the front end portion of the jib 18 is normally in contact with the ground. The contact determination condition according to this embodiment is that the tension Tm of the jib guy link 28 detected by the jib tension meter 84 is equal to or less than a fixed value as will be detailed later. In other words, in a case where the tension Tm is equal to or more than the fixed value, determination is made that the front end portion of the jib 18 is not in a normal contact state because such a force, which causes the jib 18 to float from the ground against a self-weight of the jib 18 or the like, is applied to the front end portion of the jib 18.

The information output unit 707 receives the rise and fall regulation signal from the operation regulating unit 703 and outputs notification information or a signal according to the information to the display unit 86 or the notification buzzer 87.

Figure 5:
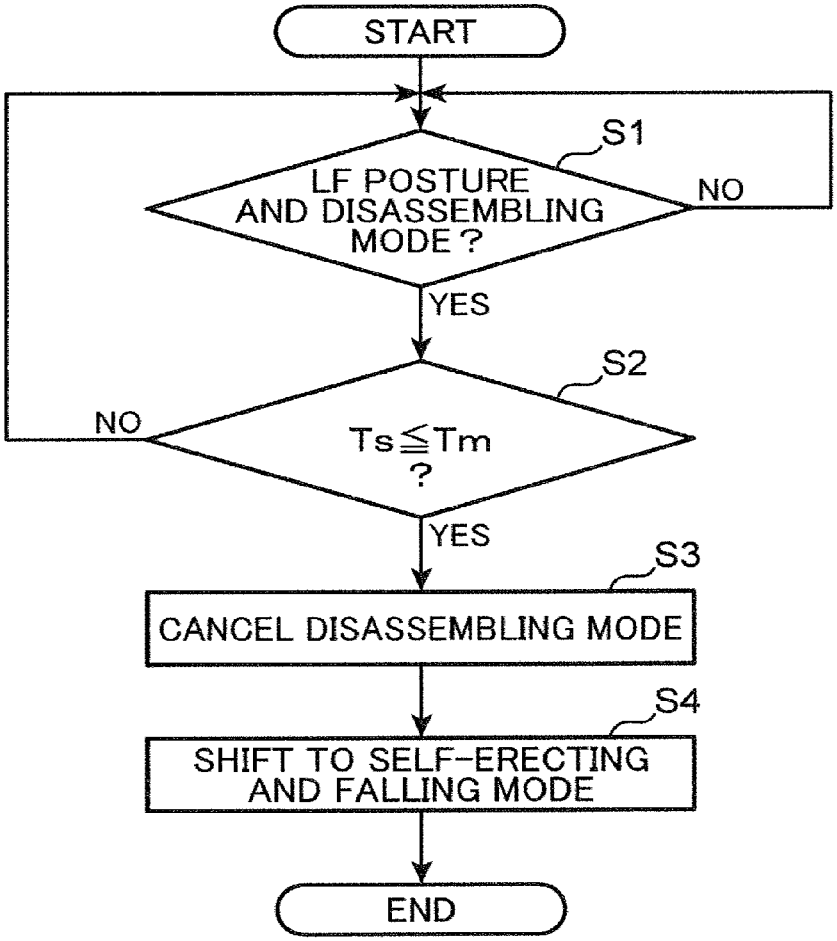
FIG. 5 is a flow chart showing processing for the crane according to one embodiment of the present invention to shift from a disassembling mode to a self-erecting and falling mode.
Figure 6:
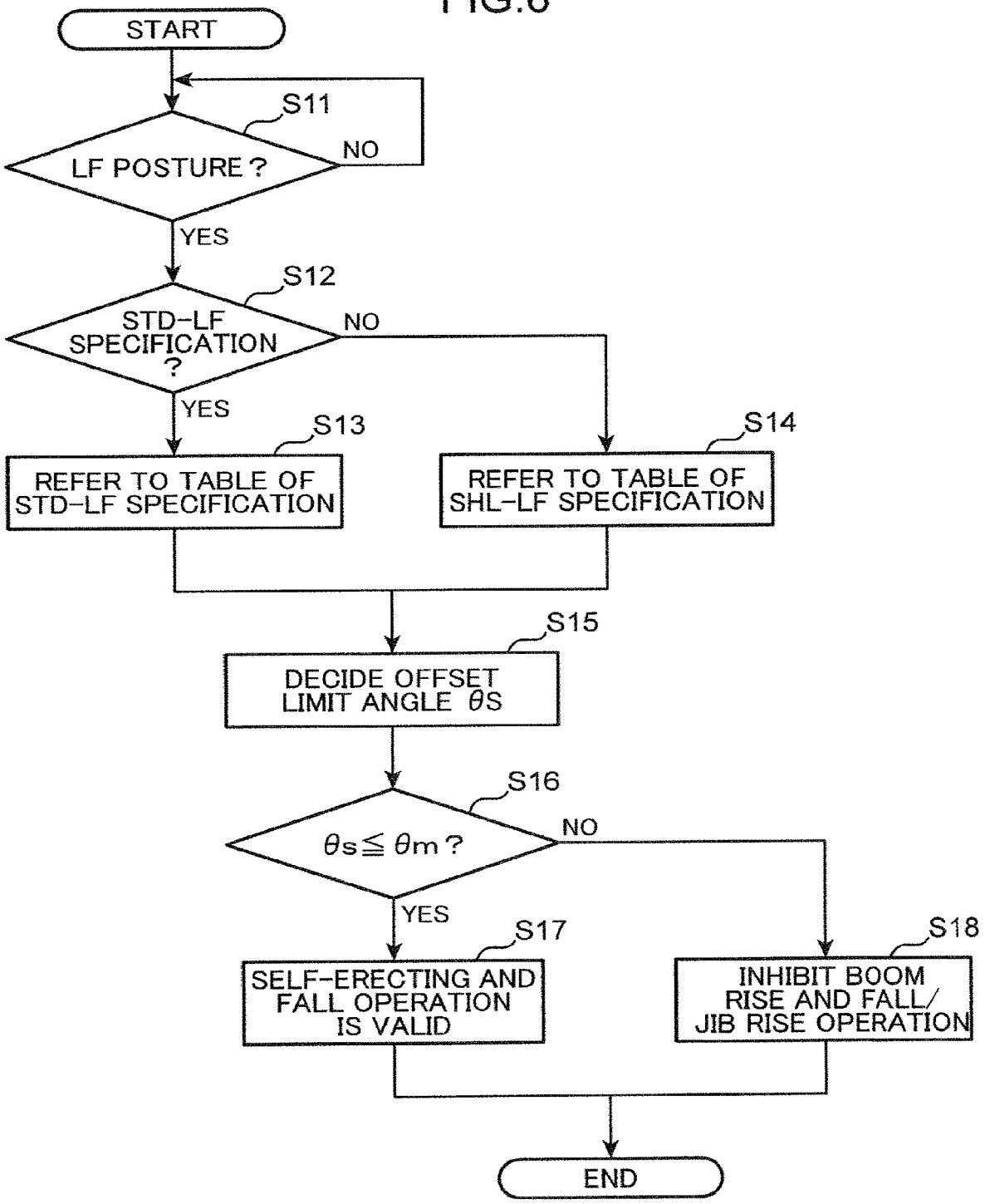
FIG. 6 is a flow chart showing processing of the crane according to one embodiment of the present invention in the self-erecting and falling mode.
Figure 7:
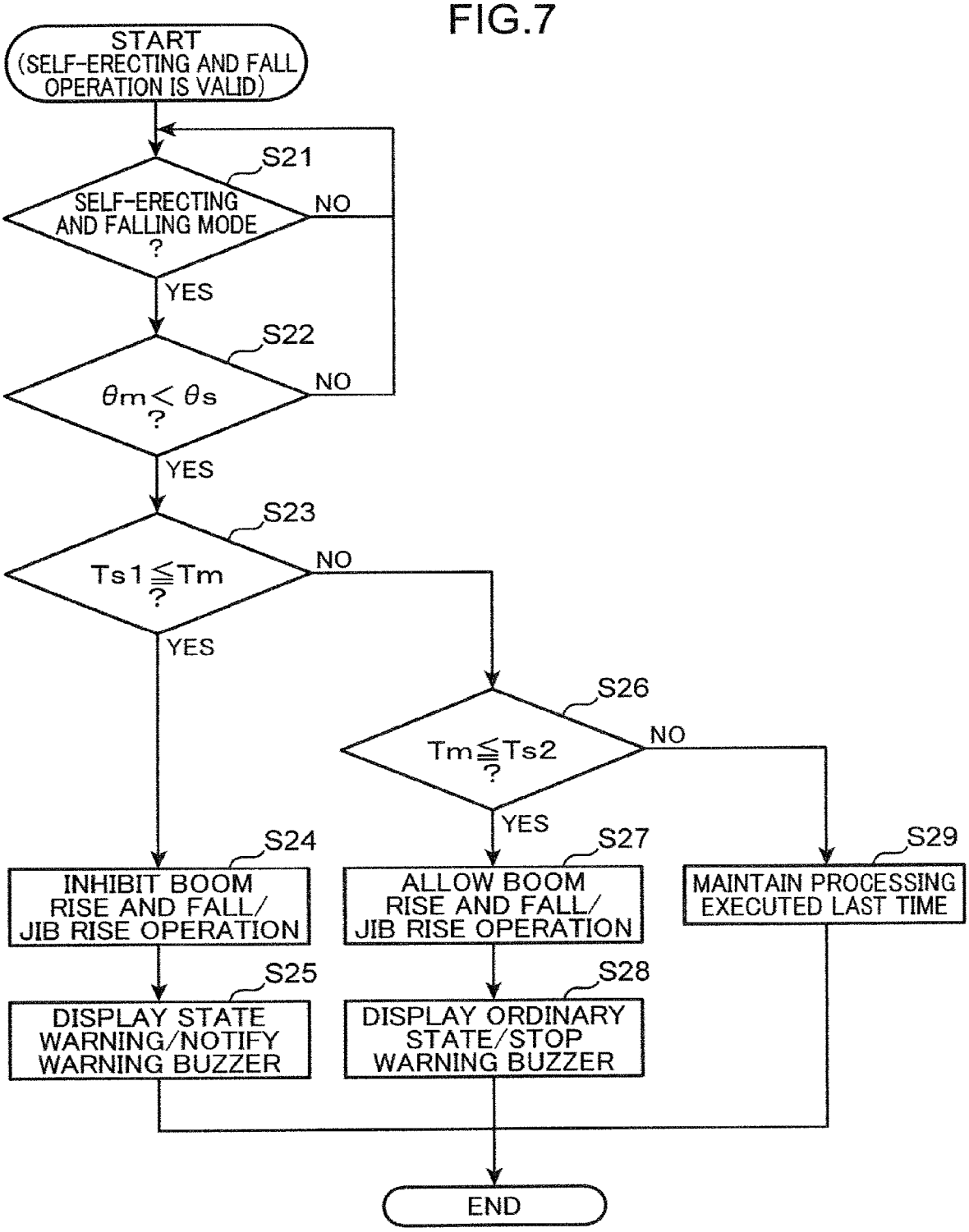
FIG. 7 is a flow chart showing processing of the crane according to one embodiment of the present invention in the self-erecting and falling mode.

FIG. 5 is a flow chart showing processing for the crane 1 (1A and 1B) according to the present embodiment to shift from the disassembling mode to the self-erecting and falling mode. FIG. 6 and FIG. 7 are flow charts showing processing of the crane 1 according to the present embodiment in the self-erecting and falling mode. FIG. 8 to FIG. 14 are flow charts showing the self-erecting and fall operation of the crane 1 according to the present embodiment.

<Shift to Self-Erecting and Falling Mode>

With reference to FIG. 5, in a state where the crane 1 is set at the work posture (FIG. 1), the mode switching unit 701 executes mode switch determination processing for switching the mode of the operation regulating unit 703 from an assembly work mode to the self-erecting and falling mode. The mode switch determination processing is executed at predetermined intervals during use of the crane 1. When the mode switch determination processing is started, the determination unit 705 determines whether or not the crane 1 is at an LF posture (a luffing posture corresponding to the work posture in FIG. 1) and an execution mode of the crane 1 is the disassembling mode (Step S1). Here, when the crane 1 is at the LF posture and set to the disassembling mode (YES in Step S1), the determination unit 705 determines whether or not the tension Tm of the jib guy link 28 detected by the jib tension meter 84 is not less than a tension threshold value Ts stored in the storage unit 706 (Step S2). Here, in a case where Ts≤Tm holds (YES in Step S2), determination is made that the tension Tm of the jib guy link 28 is large enough and the jib 18 is supported by the boom 16, in other words, that the front end portion of the jib 18 floats from the ground against the self-weight of the jib 18 or the like, shift from the disassembling mode to the self-erecting and falling mode is enabled. Accordingly, the mode switching unit 701 cancels the disassembling mode (Step S3) to shift to the self-erecting and falling mode (Step S4). However, in Step S1, in a case where the crane 1 is not at the LF posture or not in the disassembling mode (NO in Step S1), determination in Step S1 will be repeated by the determination unit 705. Also in a case of Ts>Tm in Step S2 (NO in Step S2), Steps S1 and S2 will be repeated. Shift to the self-erecting and falling mode by the mode switching unit 701 is not limited to the processing in FIG. 5. The mode of the operation regulating unit 703 may be switched, for example, upon reception, by the mode switching unit 701, of an instruction for the shift to the self-erecting and falling mode which is input through the manipulation unit 85 by a worker boarding the cab 5.

<Processing in Self-Erecting and Falling Mode>

With reference to FIG. 6, even in a case where the mode switching unit 701 starts the self-erecting and falling mode of the operation regulating unit 703, only when a predetermined condition is satisfied, the fall operation and the self-erecting operation of the crane 1 are allowed. In other words, unless the predetermined condition is satisfied, the fall operation and the self-erecting operation of the crane 1 will be regulated. In the present embodiment, such allowance and regulation of the operation of the crane 1 are executed by the operation regulating unit 703 of the control unit 70. When the self-erecting and falling mode is started in FIG. 6, the determination unit 705 determines whether or not the crane 1 is at the LF posture (Step S11). Here, when the crane 1 is determined to be at the LF posture (YES in Step S11), the determination unit 705 further determines whether or not the crane 1 has the STD-LF specification (Step S12). Information about which of the STD-LF specification (FIG. 1) and the SHL-LF specification (FIG. 2) the crane 1 is set to have is input by a worker through the manipulation unit 85 and stored in the storage unit 706. In Step S11, in a case where the crane 1 is not at the LF posture (NO in Step S11), determination in Step S11 will be repeated.

In Step S12, in a case where the crane 1 has the STD-LF specification shown in FIG. 1 (YES in Step S12), the operation regulating unit 703 acquires the offset limit angle θs (a threshold value angle) from a table of the STD-LF specification stored in the storage unit 706 (Step S13). By contrast, in a case where the crane 1 does not have the STD-LF specification shown in FIG. 1 (NO in Step S12), the operation regulating unit 703 acquires the offset limit angle θs from a table of the SHL-LF specification stored in the storage unit 706 (Step S14). As a result, an offset limit angle θs appropriately set for the current specification of the crane 1 is decided (Step S15). Since the balance of the crane 1 differs in the STD-LF specification and the SHL-LF specification, offset limit angles θs different from each other are set.

Thereafter, the computation unit 704 calculates a current jib offset angle θm from the ground angle θb of the boom 16 and the ground angle θj of the jib 18. Then, the determination unit 705 compares the computed jib offset angle θm and the offset limit angle θs in magnitude (Step S16). Here, in a case of θm≥θs (YES in Step S16), the jib 18 is caused to take a posture of bending sufficiently downward to the boom 16 (the jib boom angle condition is established). Therefore, the operation regulating unit 703 allows the self-erecting operation and the fall operation of the crane 1 in the self-erecting and falling mode (Step S17, the self-erecting and fall operation is valid). By contrast, in a case of θm<θs in Step S16, the jib 18 will be arranged at a position closer to the extension of the center line of the boom 16 (the jib boom angle condition is not established) than in a case of θm≥θs. When the self-erecting operation and the fall operation of the crane 1 are executed in this state, there is a concern that the crane 1 may overturn forward. The operation regulating unit 703 therefore limits (regulates) the operations of the boom 16 and the jib 18 (Step S18).

<Execution of Self-Erecting and Fall Operation>

When the operation regulating unit 703 allows the self-erecting operation and the fall operation of the crane 1 in Step S17 of FIG. 6, while the worker manipulates the manipulation unit 85, the self-erecting operation or the fall operation of the crane 1 is executed. However, even after the self-erecting operation or the fall operation of the crane 1 is started, when a positional relationship (the jib offset angle θm) between the boom 16 and the jib 18 of the crane 1 again reaches an unstable state, the operation of the crane 1 should be regulated for preventing overturning of the crane 1. Therefore, the operation regulating unit 703 continuously executes the processing shown in FIG. 7 during the self-erecting operation or the fall operation of the crane 1.

When determination is made in Step S17 in FIG. 6 that the self-erecting and fall operation in the crane 1 is valid, the determination unit 705 makes determination of a current mode of the operation regulating unit 703 (Step S21 in FIG. 7). Here, when the operation regulating unit 703 is set to the self-erecting and falling mode (YES in Step S21), the determination unit 705 again compares the latest jib offset angle θm and the offset limit angle θs in magnitude (Step S22). In a case of θm<θs (YES in Step S22), because the jib offset angle θm is too small, it is concerned that the crane 1 may overturn. Then, the determination unit 705 compares the tension Tm of the jib guy link 28 and a first threshold value tension Ts1 set in advance and stored in the storage unit 706 in magnitude (Step S23). In Step S23 and Step S26 to be described later, determination is made whether or not the front end portion (the wheel 65S) of the jib 18 lands on a ground G while taking into consideration a predetermined measurement error in the tension Tm. The first threshold value tension Ts1 is a threshold value set for determining lift-off of the front end portion (the wheel 65S) of the jib 18.

In a case of Ts1≤Tm in Step S23 (YES in Step S23), the tension Tm is larger than the first threshold value tension Ts1, i.e., the contact determination condition is not satisfied, so that determination is made that a sufficient tension is generated in the jib guy link 28, in other words, that a floating force is acting which is enough for making the wheels 65S arranged at the front end portion of the jib 18 to float from the ground. In this case, since the jib offset angle θm is small and the front end portion of the jib 18 is floating from the ground, the crane 1 might be overturned. The operation regulating unit 703 therefore limits at least a part of the operation of the boom 16 and the jib 18 (Step S24). For notifying a worker in the cab 5 or other workers in the surroundings of the crane 1 of the danger, the operation regulating unit 703 also controls the information output unit 707 to cause the display unit 86 to display information related to a possibility of overturning of the crane 1 (display a state warning). The operation regulating unit 703 also causes the notification buzzer 87 to notify a warning buzzer sound (Step S25).

On the other hand, in a case of Ts1>Tm in Step S23, since the tension Tm is smaller than the first threshold value tension Ts1, the determination unit 705 compares the tension Tm and a second threshold value tension Ts2 smaller than the first threshold value tension Ts1 set in advance (Step S26). Here, in a case of Tm≤Ts2 (YES in Step S26), the tension Tm of the jib guy link 28 is small enough to have the jib guy links 28 slacking, so that the wheels 65S arranged at the front end portion of the jib 18 can be considered to be normally in contact with the ground. The operation regulating unit 703 therefore allows all the rise operation and the fall operation of the boom 16 and the rise operation and the fall operation of the jib 18 (Step S27). Further, for notifying the worker in the cab 5 or other workers in the surroundings of the crane 1 of the safety of the crane 1, the operation regulating unit 703 also controls the information output unit 707 to cause the display unit 86 to display information suggesting that the crane 1 is in an ordinary state (display an ordinary state). In a case where the notification buzzer 87 has notified the warning buzzer sound, the operation regulating unit 703 stops the buzzer sound (Step S28). By contrast, in a case of Tm>Ts2 in Step S26 (NO in Step S26), the wheels 65S arranged at the front end portion of the jib 18 cannot be always considered to be normally in contact with the ground in view of a measurement error of the tension Tm of the jib guy link 28. In other words, it is apparent that at least a force which makes the wheels 65S to float from the ground is acting against the self-weight of the jib 18. The operation regulating unit 703 therefore maintains the processing of FIG. 7 (any of Steps S24, S27, and S29) executed last time. Thereafter, the operation regulating unit 703 finishes the processing of FIG. 7, as well as repeating the processing of FIG. 7 at predetermined intervals (e.g. several seconds).

In Step S18 of FIG. 6 and in Step S24 of FIG. 7, the operation regulating unit 703 limits the operations of the boom 16 and the jib 18. Specifically, in a case where the jib boom angle condition is not established during execution of the self-erecting and falling mode, the operation regulating unit 703 outputs, to the drive control unit 702, a signal which regulates take-up and draw-out of the boom raising and lowering rope 38 (the boom raising and lowering rope 93) (the rise operation and the fall operation of the boom 16) and take-up of the jib raising and lowering rope 44 (the rise operation of the jib 18) as the fall regulation signal. At this time, draw-out of the jib raising and lowering rope 44 (the fall operation of the jib 18) is allowed.

<Self-Erecting Operation of Crane>

Next, the self-erecting operation of the crane 1 to be executed in the processing of FIG. 7 will be described with reference to FIG. 1, and FIG. 8 to FIG. 14. FIG. 8 to FIG. 14 illustrate the boom 16, the jib 18, the rear strut 21, and the front strut 22 and omit illustration of the other members (the upper slewing body 4 and the like) of the crane 1. At the stage of the assembly of the crane 1, the boom 16 is attached to the upper slewing body 4 (FIG. 1) and the jib 18 is attached to the front end portion of the boom 16. Additionally, the rear strut 21 and the front strut 22 are attached to the front end portion of the boom 16 and the base end portion of the jib 18, respectively. Further, the base end portion of the boom 16 and a front end portion of the rear strut 21 are connected by the strut guy links 26, and the front end portion of the front strut 22 and the front end portion of the jib 18 are connected by the jib guy links 28. Between the sheave block 47 arranged at the front end portion of the rear strut 21 and the sheave block 48 arranged at the front end portion of the front strut 22, the jib raising and lowering rope 44 is wound a plurality of times. Accordingly, take-up and draw-out of the jib raising and lowering rope 44 by the jib raising and lowering winch 32 enables the rise and fall operation of the jib 18. Although not illustrated in FIG. 8 to FIG. 14, the boom guy line 66 is connected to the front end portion of the boom 16 in advance, whereby take-up and draw-out of the boom raising and lowering rope 38 by the boom raising and lowering winch 30 enables the rise and fall operation of the boom 16 together with the mast 12.

In the state shown in FIG. 8, the jib guy link 28 slacks, and the tension Tm of the jib guy link 28 detected by the jib tension meter 84 (FIG. 3) is less than the second threshold value tension Ts2. Additionally, the jib offset angle θm is equal to zero. Therefore, in the processing in the self-erecting and falling mode shown in FIG. 6, the self-erecting and fall operation is allowed through Steps S11, S12, S13, S15, S16, and S17. As one example, the offset limit angle θs decided in Step S15 is 45°.

When in the state shown in FIG. 8, the self-erecting and falling mode started by an instruction by a worker, the worker takes up the boom raising and lowering rope 38 by the boom raising and lowering winch 30, thereby starting the rise operation of the boom 16. As a result, as shown in FIG. 9, the ground angle θb of the boom 16 is increased. In the state shown in FIG. 9, as the boom 16 rises, the jib 18 swings centered around the jib foot pin 29 and moves rearward so as to follow the boom 16. At this time, the wheels 65S arranged at the front end portion of the jib 18 roll on the ground. As the jib 18 moves, the ground angle θj of the jib 18 is increased. With reference to FIG. 9, the computation unit 704 (FIG. 3) is capable of computing Om according to a relational expression of the jib offset angle θm=θb+θj. In FIG. 9, the jib offset angle θm is about 30°. Therefore, although the processing of FIG. 7 proceeds from Step S22 to S23, because the tension Tm of the jib guy link 28 is still less than the second threshold value tension Ts2, the processing proceeds to Steps S27 and S28. As a result, the rise operation of the boom 16 is continuously allowed.

Figure 10:
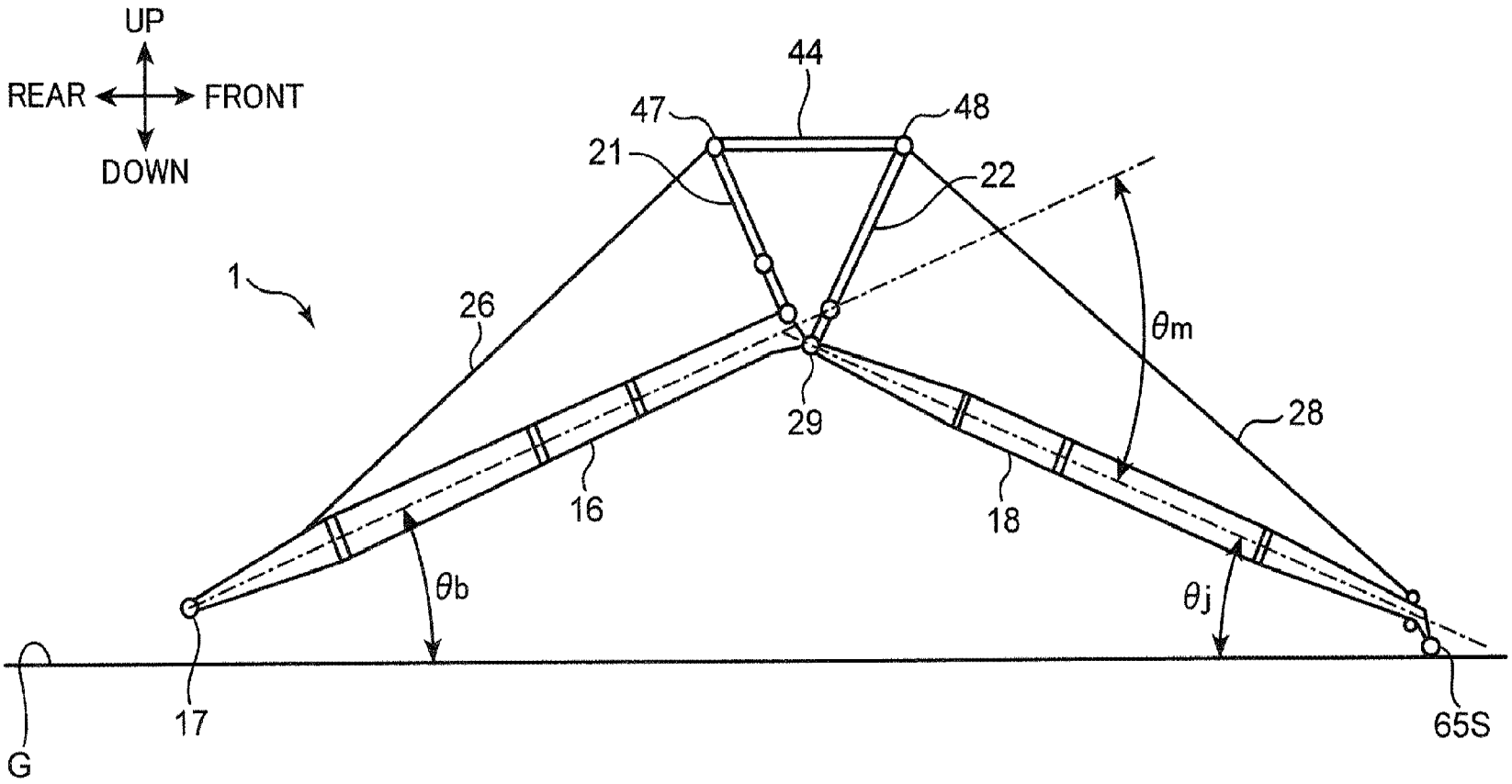
FIG. 10 is a step view showing the self-erecting and fall operation of the crane according to one embodiment of the present invention.

When the boom 16 is kept rising from the state shown in FIG. 9, the jib guy links 28 will be stretched before long to increase the tension Tm as shown in FIG. 10. Since the jib offset angle θm is 44° in FIG. 10, the processing of FIG. 7 proceeds from Step S22 to S23. When the worker continues the rise operation of the boom 16 in the way it is, the tension Tm becomes larger than the first threshold value tension Ts1. Therefore, the processing proceeds from Step S23 to S24 and S25 of FIG. 7, so that the operation regulating unit 703 limits the rise operation and the fall operation of the boom 16 and the rise operation of the jib 18. If the rise and fall operation of the boom 16 is continued to cause the jib 18 to float from the ground, the crane 1 might overturn forward. Limiting processing by the operation regulating unit 703 therefore prevents such a phenomenon beforehand. At this time, the reason why the fall operation of the boom 16 (draw-out of the jib raising and lowering rope 44) is also limited is that when the boom 16 is fallen with the front end portion of the jib 18 floating above the ground, a moment in a direction in which the upper stewing body 4 and the lower travelling body 2 float from the ground is increased and the crane 1 might similarly overturn. Additionally, for preventing further floating-up of the front end portion of the jib 18, rise of the jib 18 (take-up of the jib raising and lowering rope 44) is limited.

In a case where Steps S24 and 25 of FIG. 7 impose such limits as described above, the worker conducts the allowed fall operation of the jib 18. Specifically, when the jib raising and lowering rope 44 is drawn out by the jib raising and lowering winch 32, a distance between the sheave block 47 and the sheave block 48 is increased, so that the jib 18 falls. As a result, the front end portion (the wheel 65S) of the jib 18 again lands, and the tension Tm becomes smaller than the second threshold value tension Ts2 (Steps S27 and S28 of FIG. 7). In other words, the contact determination condition is again satisfied for considering the front end portion to be normally in contact with the ground. Accordingly, resumption of the rise operation of the boom 16 is enabled. Alternatively, an increase in the jib offset angle θm to be larger than the offset limit angle θs by the fall of the jib 18 again allows the operations of the boom 16 and the jib 18.

Figure 11:
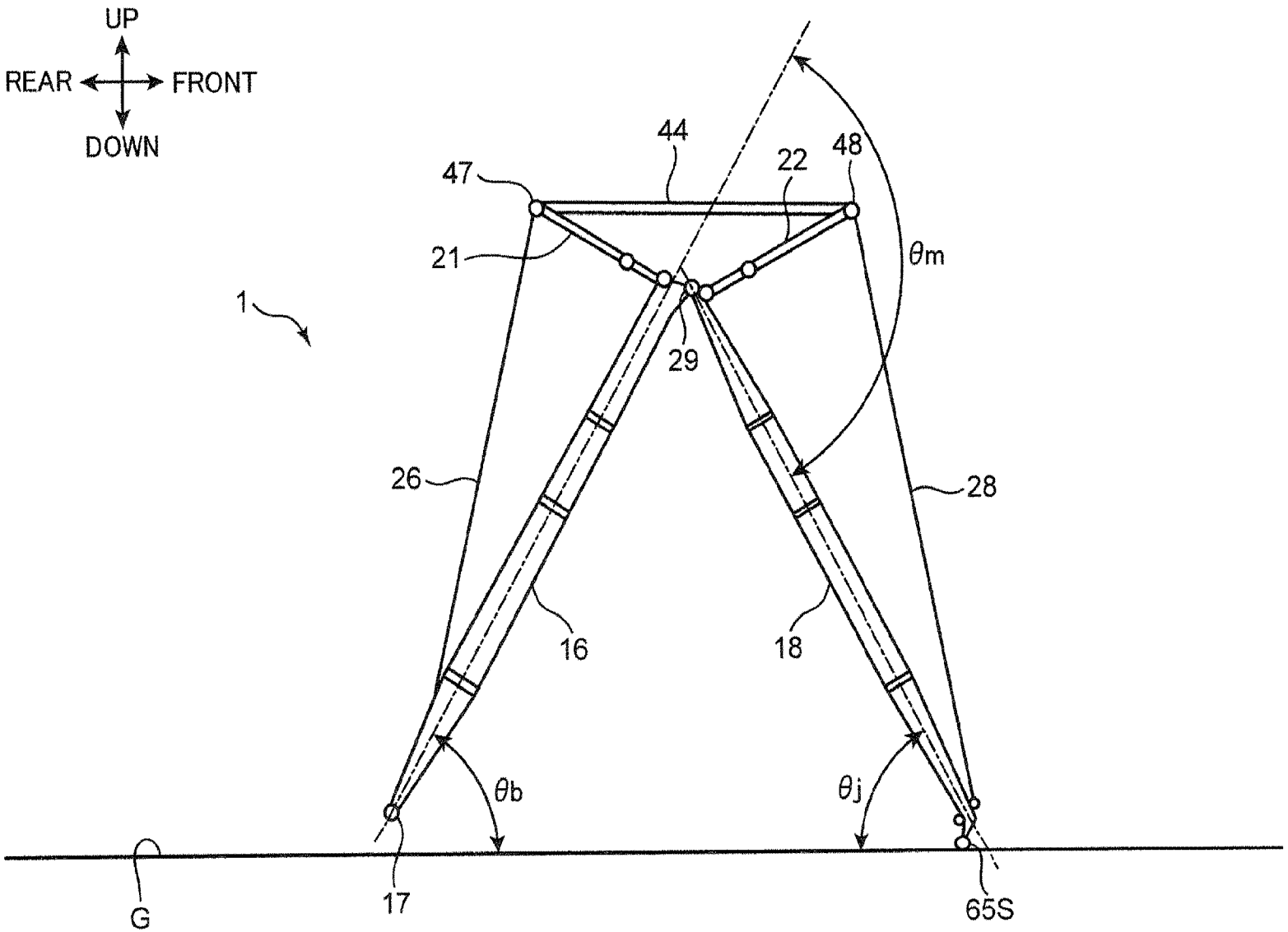
FIG. 11 is a step view showing the self-erecting and fall operation of the crane according to one embodiment of the present invention.
Figure 12:
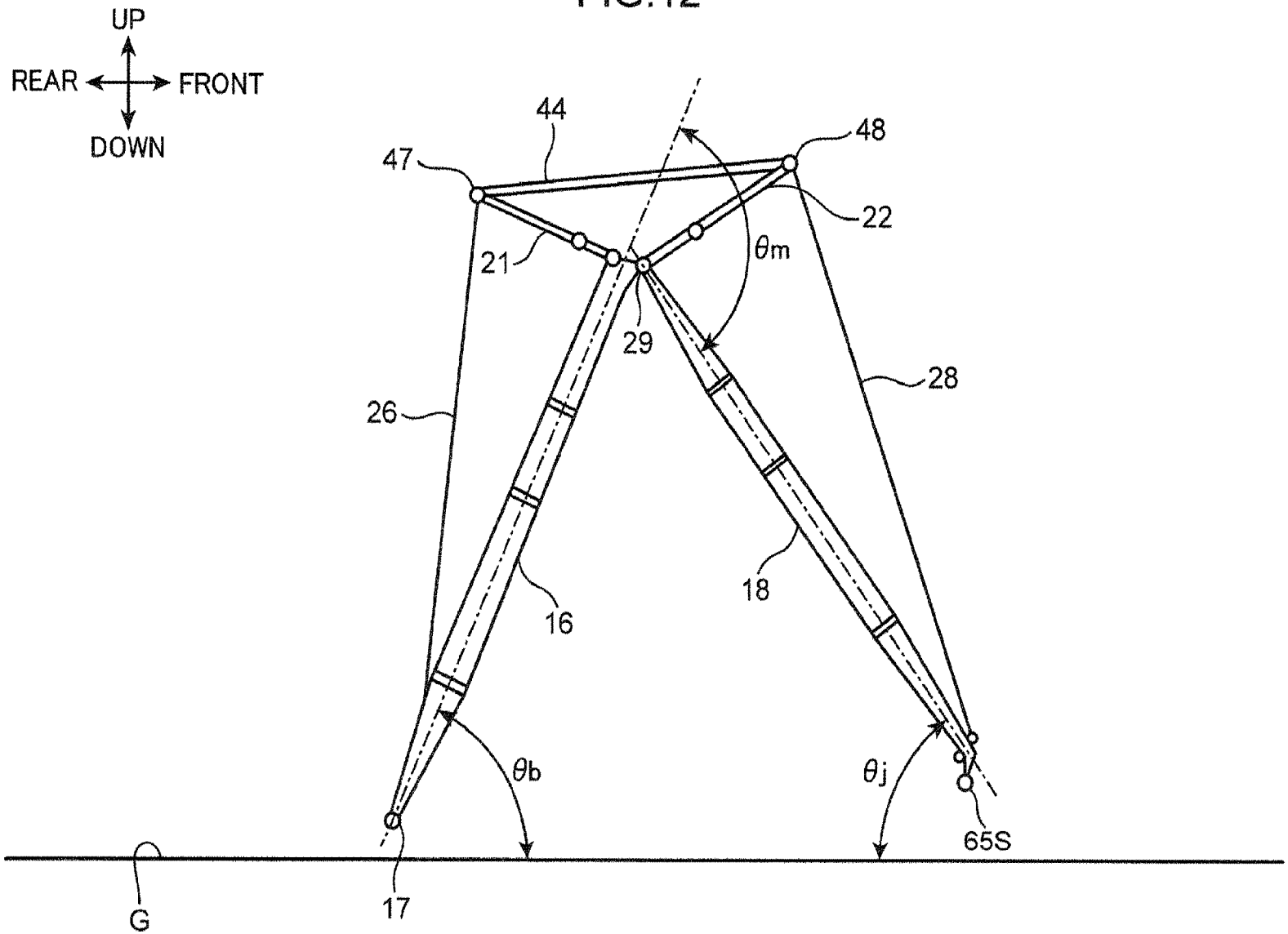
FIG. 12 is a step view showing the self-erecting and fall operation of the crane according to one embodiment of the present invention.
Figure 13:
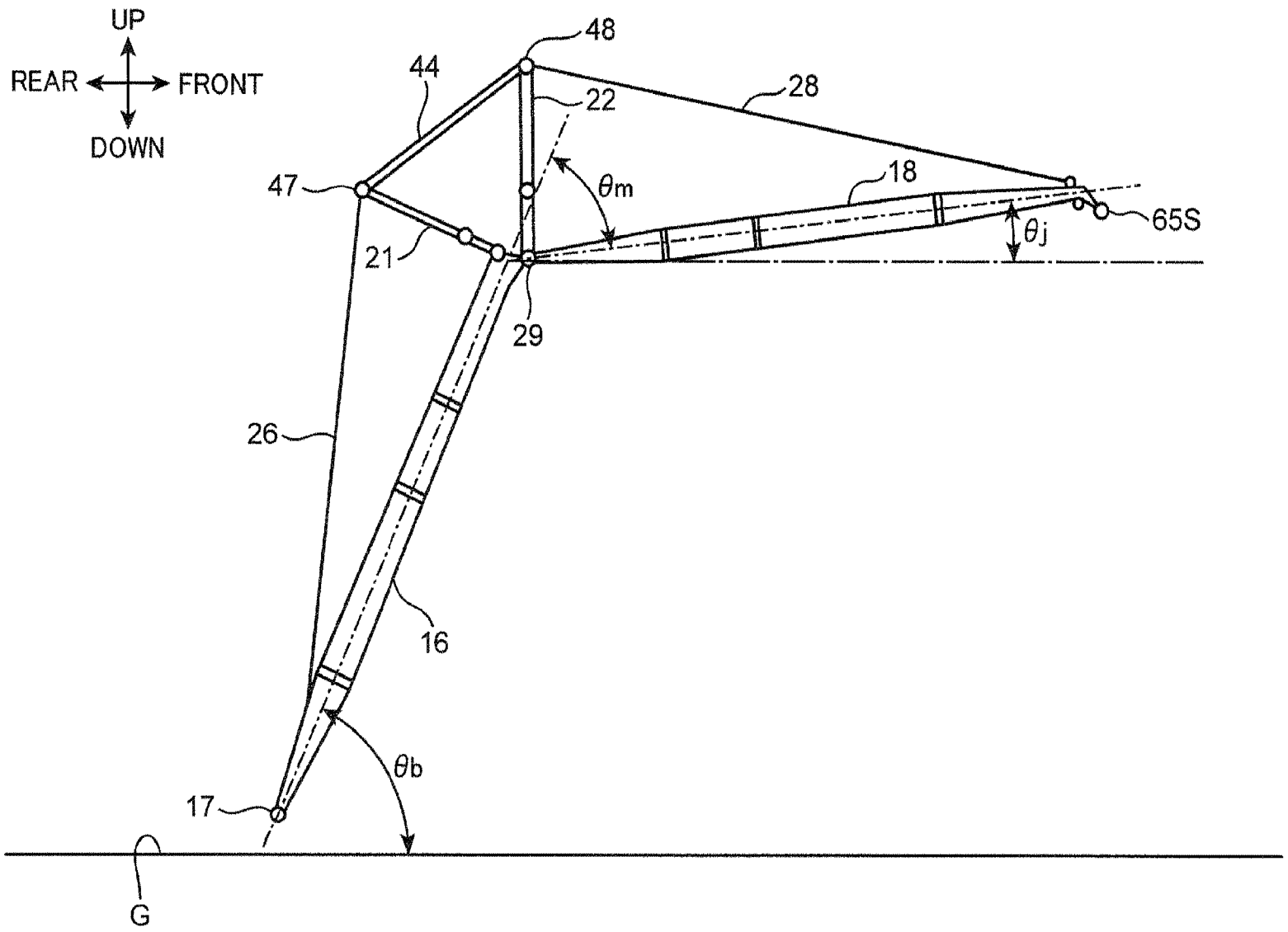
FIG. 13 is a step view showing the self-erecting and fall operation of the crane according to one embodiment of the present invention.
Figure 14:
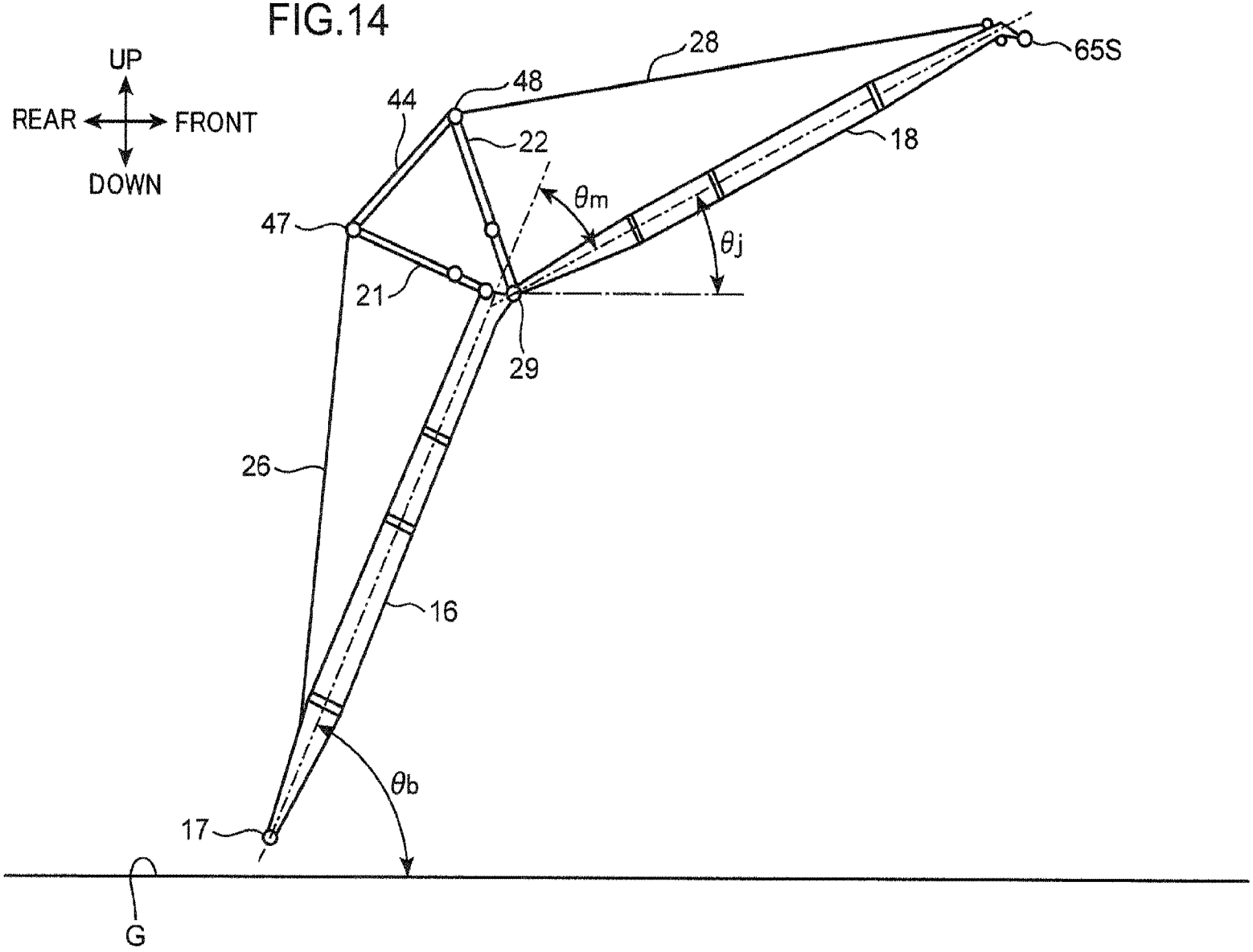
FIG. 14 is a step view showing the self-erecting and fall operation of the crane according to one embodiment of the present invention.

Thereafter, when the boom 16 continues rising while the wheel 65S of the jib 18 is maintained in contact with the ground, the crane 1 is caused to take such a posture as shown in FIG. 11. In FIG. 11, the jib offset angle θm is about 120°. In this case, since θm>θs (45°) holds, determination of NO is made in Step S22 of FIG. 7 to continuously allow the rise of the boom 16. Then, even if the front end portion of the jib 18 floats from the ground due to the rise operation of the boom 16 as shown in FIG. 12, because the jib offset angle θm is large enough, the crane 1 will not overturn. Thereafter, as shown in FIG. 13 and FIG. 14, the boom 16 is kept rising and the crane 1 is set to such a work posture as shown in FIG. 1 before long. While in FIG. 13, the jib offset angle θm is 60°, the jib offset angle θm is 40° in FIG. 14. In this case, although the operations of the boom 16 and the jib 18 are limited in Steps S24 and S25 based on the processing shown in FIG. 7, since the ground angle θb of the boom 16 already exceeds a predetermined angle (a boom limit angle, e.g. 65°) and the crane 1 is included in the work allowable range, the above-described moment limiting function operates. Therefore, the operation regulating unit 703 forcedly cancels the processing shown in FIG. 7. In other words, when the rise operation of the crane 1 is conducted in the steps shown in FIG. 8 to FIG. 14, the limiting processing executed by the operation regulating unit 703 need only be conducted exclusively in a case where the ground angle θb of the boom 16 is equal to or less than the boom limit angle (65°) set in advance.

In a case where in the middle of the states shown in FIG. 11 to FIG. 13, the jib offset angle θm lowers the offset limit angle θs, the operation regulating unit 703 limits the operations of the boom 16 and the jib 18 based on Steps S24 and S25 of FIG. 7. In this case, when the jib offset angle θm becomes larger than the offset limit angle θs due to the fall operation of the jib 18, the operation regulating unit 703 enables the rise operation of the boom 16 to be resumed.

<Fall Operation of Crane>

Next, the fall operation of the crane 1 to be executed in the processing of FIG. 7 will be described similarly with reference to FIG. 1, and FIG. 8 to FIG. 14. In a case where the posture of the crane 1 needs to be changed from the work posture in FIG. 1 to the fall posture in FIG. 8, the worker manipulates the manipulation unit 85 to instruct the mode switching unit 701 of the control unit 70 to shift to the self-erecting and falling mode. At this time, if the execution mode of the crane 1 is set to the disassembling mode, the disassembling mode will be shifted to the self-erecting and falling mode (because of the tension Tm>Ts in the postures shown in FIG. 1) according to the flow shown in FIG. 5. Although at the time of shift to the self-erecting and falling mode, it is desirable to once set the disassembling mode in advance in consideration of safety of the work, the execution mode of the crane 1 may be shifted from the ordinary work mode directly to the self-erecting and falling mode as will be described later. In the self-erecting and falling mode, the boom 16 and the jib 18 are allowed to fall to a range in which the front end portion of the jib 18 exceeds the work allowable range (a work allowable radius).

From the state shown in FIG. 1 until the ground angle θb of the boom 16 becomes smaller than the predetermined boom limit angle (65°), the fall operation of the boom 16 (draw-out of the boom raising and lowering rope 38) and the fall operation of the jib 18 (draw-out of the jib raising and lowering rope 44) are allowed. As shown in FIG. 11, the wheel 65S at the front end portion of the jib 18 lands before long through the states shown in FIG. 14, FIG. 13, and FIG. 12. Meanwhile, when the ground angle θb becomes smaller than the predetermined angle (65°), execution of the limiting processing by the operation regulating unit 703 is enabled (FIG. 7). During the fall operation of the crane 1, the tension Tm of the jib guy link 28 is larger than the first threshold value tension Ts1. Therefore, when the jib offset angle θm becomes smaller than the offset limit angle θs, Steps S24 and S25 are executed through Steps S22 and S23 of FIG. 7. At this time, for preventing the crane 1 from overturning forward, the operation regulating unit 703 limits the rise and fall operation of the boom 16 (take-up and draw-out of the boom raising and lowering rope 38) and the rise operation of the jib 18 (take-up of the jib raising and lowering rope 44). For preventing such a moment from being applied as causes the upper slewing body 4 to float as described above, the rise operation of the boom 16 is limited similarly to the self-erecting operation of the crane 1.

From the state shown in FIG. 11, the boom 16 and the jib 18 are caused to take an overhanging posture above the ground (FIG. 8) through the states shown in FIG. 10 and FIG. 9 by draw-out of the boom raising and lowering rope 38 and draw-out of the jib raising and lowering rope 44. However, in a case where the jib offset angle θm meanwhile becomes smaller than the offset limit angle θs due to unintended manipulation by the worker or the like in a state where the tension Tm of the jib guy link 28 exceeds the first threshold value tension Ts1, the limiting processing by the operation regulating unit 703 is executed. After the wheel 65S lands on the ground, the operations of the boom 16 and the jib 18 are all allowed by Steps S27 and S28 of FIG. 7.

In the self-erecting and fall operation of the crane 1, only when the front end portion of the jib 18 enters the outside of the work allowable range (the radius) set in advance, the limiting processing by the operation regulating unit 703 needs to be executed. In other words, in a case where the front end portion of the jib 18 is positioned within the work allowable range, the operations of the boom 16 and the jib 18 need not be limited since stability of the crane 1 is maintained.

As described in the foregoing, in the present embodiment, the operation regulating unit 703 which regulates swinging of the jib 18 and the boom 16 has the ordinary work mode and the self-erecting and falling mode (the fall allowed mode and the self-erecting allowed mode). In the ordinary work mode, the operation regulating unit 703 regulates swinging of the boom 16 and the jib 18 so that the front end portion of the jib 18 is included in the work allowable range set according to a weight of the suspended load (the moment limiting function). Therefore, it is possible to safely execute hoist-up work of the suspended load. On the other hand, in the self-erecting and falling mode, the operation regulating unit 703 allows the front end portion of the jib 18 to enter the outside of the work allowable range irrespective of a weight of the suspended load, as well as allowing the crane 1 to change a posture between the fall posture and the work posture according to a determination result of the determination unit 705. Therefore, it is possible to determine a possibility of overturning of the crane 1 according to the magnitude of the jib offset angle θm.

The operation regulating unit 703 also allows the crane to change a posture from the work posture to the fall posture in the self-erecting and falling mode. When the determination unit 705 determines that the jib boom angle condition is not established during the execution of the self-erecting and falling mode, the operation regulating unit allows the fall operation of the jib 18, while outputting the rise and fall regulation signal irrespective of manipulation accepted by the manipulation unit 85 to regulate the rise and fall operation of the boom 16 and the rise operation of the jib 18. The operation regulating unit 703 also allows the rise and fall operation of the boom 16 and the rise and fall operation of the jib 18, respectively, when the determination unit 705 determines that the jib boom angle condition is established. The jib boom angle condition is established in a case where the jib offset angle θm is larger than the offset limit angle θs formed of an acute angle set in advance. Therefore, it is possible to prevent an opening angle between the boom 16 and the jib 18 (an exterior angle in a case where the jib offset angle is set to be an interior angle) from becoming too large, thereby enabling the crane 1 in a state of having the moment limiting function cancelled to safely change a posture from the work posture to the fall posture while preventing overturning of the crane 1 beforehand. As a result, it is possible to reduce a worker's burden of giving attention to overturning of the crane 1 in the falling work.

Additionally in the present embodiment, in a case where the jib boom angle condition is not established in the self-erecting and falling mode, the operation regulating unit 703 outputs, to the drive control unit 702, a signal which regulates take-up and draw-out of the boom raising and lowering rope 38 (the boom raising and lowering rope 93) and take-up of the jib raising and lowering rope 44. Therefore, it is possible to quickly limit drive of the boom raising and lowering winch 30 (91) and the jib raising and lowering winch 32 when the crane 1 takes a posture which is likely to cause overturn.

Further, in the present embodiment, in a case where the jib boom angle condition is not established at the falling work in the self-erecting and falling mode, the operation regulating unit 703 outputs a signal for displaying warning information to the display unit 86. Therefore, it is possible to quickly notify the worker that the crane 1 takes a posture which is likely to cause overturn. As a result, overturning of the crane 1 can be prevented beforehand.

Also in the present embodiment, the operation regulating unit 703 in the self-erecting and falling mode allows the crane to change a posture from the fall posture to the work posture. Then, when the determination unit 705 determines that the jib boom angle condition is not established during execution of the self-erecting and falling mode and the state of the jib does not satisfy the contact determination condition, i.e., the condition for determining that the jib is normally in contact with the ground, the operation regulating unit 703 regulates the rise and fall operation (the rise operation and the fall operation) of the boom 16 and the rise operation of the jib 18. By contrast, in a case where the determination unit 705 determines that the jib boom angle condition is established or the contact determination condition is satisfied, the operation regulating unit 703 allows the rise and fall operation of the boom 16 and the rise and fall operation of the jib 18. Therefore, continuation of the state of the front end portion of the jib 18 floating from the ground is prevented in a state where the opening angle between the boom 16 and the jib 18 (an exterior angle in a case where the jib offset angle θm is set to be an interior angle) is large. As a result, while preventing the crane 1 from overturning beforehand, it is possible to safely change the posture of the crane 1, with the moment limiting function cancelled, from the fall posture to the work posture (self-erecting). Further, it is possible to reduce a worker's burden of giving attention to overturning of the crane 1 in self-erecting work.

Here, "the predetermined contact determination condition for determining whether or not the front end portion of the jib 18 is normally in contact with the ground" may be a condition for determining whether or not the front end portion of the jib 18 is actually in contact with the ground, or may be a condition for excluding, from "the normal contact", a state, being not considered the normal contact, where a contact pressure of the jib 18 with respect to the ground is drastically reduced due to more than a fixed floating force is acting in a direction in which the front end portion of the jib 18 is made to float from the ground against the self-weight of the jib 18 or the like.

For example, the above-described configuration may further include the jib tension meter 84 (a tension detection unit) which detects the tension Tm of the jib raising and lowering rope 44, in which the determination unit 705 (the jib contact state determination unit) may determine that the contact determination condition is satisfied which is for determining that the front end portion of the jib 18 is normally in contact with the ground in a case where the tension Tm detected by the jib tension meter 84 is equal to or less than the tension threshold value Ts set in advance. According to this configuration, it is possible to detect whether or not the front end portion of the jib 18 is normally in contact with the ground, in other words, whether the front end portion of the jib 18 is actually floating above the ground or might float, by using the magnitude of the tension Tm of the jib raising and lowering rope 44.

Also in the present embodiment, at the time of the self-erecting work, in a case where none of the jib boom angle condition and the contact determination condition are established, the operation regulating unit 703 outputs a signal for displaying warning information for the display unit 86. Therefore, it is possible to quickly notify the worker that the crane 1 is close to the posture likely to cause overturn. As a result, overturning of the crane 1 can be prevented beforehand.

In the present embodiment, it is also possible to decide the jib offset angle θm from detection results of the boom angle meter 81 and the jib angle meter 82 which are often provided in ordinary cranes. As a result, it can be determined whether or not the jib boom angle condition is established by using these angle meters.

Further, in the present embodiment, the storage unit 706 stores a plurality of offset limit angles θs according to a combination of the length of the jib 18 and the length of the boom 16. Therefore, even when the jib 18 and the boom 16 having different lengths are attached to the upper stewing body 4 to change the posture which is likely to cause overturning of the crane 1, an appropriate offset limit angle θs according to the length information can be acquired. Further, the storage unit 706 stores the plurality of offset limit angles θs according to, in addition to the length of the jib 18 and the length of the boom 16, a combination of weights of the counterweights 13 (the palette weights 96).

Therefore, even when the counterweights 13 and the palette weights 96 having different weights are attached to the upper slewing body 4 or to the rear side of the upper slewing body 4 to change the posture which is likely to cause overturning of the crane 1, an appropriate offset limit angle θs can be acquired according to the length information.

As shown in FIG. 7, by determining a magnitude of the tension Tm of the jib raising and lowering rope 44 during execution of the self-erecting and falling mode, the overturning of the crane 1 can be prevented in either of a case where the crane 1 changes a posture from the work posture to the fall posture and a case where the crane 1 changes a posture from the fall posture to the work posture. Specifically, in a case where the crane 1 changes a posture from the work posture to the fall posture, since the tension Tm of the jib raising and lowering rope 44 is often larger than the first threshold value tension Ts1, determination of a magnitude of the tension Tm is not necessarily required. However, including such determination processing as shown in FIG. 7 enables determination for preventing the overturning of the crane 1 to be reliably made by one flow processing in either of the self-erecting operation and the fall operation of the crane 1.

Additionally, a posture changing method of the crane 1 according to the present embodiment includes regulating swinging of the boom 16 and the jib 18 according to the ordinary work mode and the self-erecting and falling mode (the fall allowed mode and the self-erecting allowed mode) set in advance. In the ordinary work mode, swinging of the boom 16 and the jib 18 is regulated so that the front end portion of the jib 18 is included in the work allowable range set according to a weight of the suspended load at the work posture of the crane 1 at which the boom 16 rises with respect to the upper stewing body 4 and the jib 18 rises with respect to the boom 16, and the crane 1 is allowed to execute the ordinary work. Additionally, in the self-erecting and falling mode (the fall allowed mode), the front end portion of the jib 18 is allowed to enter the outside of the work allowable range irrespective of a weight of the suspended load, and the crane 1 is allowed to change a posture between the fall posture, at which the boom 16 and the jib 18 fall forward of the work posture and the front end portion of the jib 18 (the wheel 65S) lands on the ground, and the work posture according to establishment of the jib boom angle condition which is established in a case where the jib offset angle θm as an angle defined by the extension of the center line of the boom 16 and the center line of the jib 18 when viewed from the direction parallel to the jib foot pin 29 (the second rotation axis) is larger than the offset limit angle θs set in advance. Such a method enables the hoist-up work of the suspended load to be safely executed in the ordinary work mode. By contrast, in the self-erecting and falling mode, when the crane 1 changes a posture between the work posture and the fall posture, the boom 16 or the jib 18 is not moved while having the angle formed by the boom 16 and the jib 18 remaining large. Therefore, while preventing the crane 1 from overturning forward beforehand, it is possible to safely change the posture of the crane 1 between the work posture and the fall posture with the moment limiting function cancelled.

Further, in the posture changing method of the crane 1, in a case where the jib boom angle condition, which is established when the jib offset angle θm is larger than the offset limit angle θs (the threshold value angle), is not established during the fall operation in the self-erecting and falling mode, only the fall operation of the jib 18 is allowed, and irrespective of manipulation accepted by the manipulation unit 85, the rise and fall operation of the boom 16 and the rise operation of the jib 18 are regulated. By contrast, in a case where the jib boom angle condition established in the fall allowed mode, while allowing the rise and fall operation of the boom 16 and the rise and fall operation of the jib 18, the crane 1 is caused to change a posture from the work posture to fall posture. According to such a method, the hoist up work of the suspended load can be safely executed in the ordinary work mode, and the boom 16 or the jib 18 will not be moved in the fall allowed mode while having an angle formed by the boom 16 and the jib 18 remaining large when the crane 1 is caused to have a posture changed from the work posture to the fall posture. Therefore, while preventing the crane 1 from overturning forward beforehand, it is possible to safely change the posture of the crane 1 from the work posture to the fall posture with the moment limiting function cancelled.

Additionally, the self-erecting and falling mode of the crane 1 allows the crane 1 to change a posture from the fall posture to the work posture. The posture changing method of the crane 1 includes regulating the rise operation and the fall operation of the boom 16, and the rise operation of the jib 18 in a case where in the self-erecting and falling mode (the self-erecting allowed mode), the jib offset angle θm is smaller than the offset limit angle θs, and the contact determination condition for determining whether or not the front end portion of the jib 18 is normally in contact with the ground is not satisfied, and in a case where during execution of the self-erecting and falling mode, at least the jib offset angle θm is larger than the offset limit angle θs or the contact determination condition is satisfied, while allowing the rise operation and the fall operation of the boom 16, and the rise operation and the fall operation of the jib 18, respectively, causing the crane 1 to change a posture from the fall posture to the work posture. According to such a posture changing method, at the time of the self-erecting operation of the crane 1, without the angle formed by the boom 16 and the jib 18 remaining large, the boom 16 or the jib 18 is moved to enable the crane 1, with the moment limiting function cancelled, to safely change a posture from the fall posture to the work posture while preventing the crane 1 from overturning forward beforehand.

The foregoing is the description of the crane 1 and the posture changing method of the crane 1 according to one embodiment of the present invention. The present invention is not limited to the embodiment. As the crane according to the present invention, the following modifications can be adopted as shown below.

(1) Although in the above-described embodiment, the description has been made of the mode in which when a predetermined condition is established, the operation regulating unit 703 outputs a signal which limits the operations of the boom 16 and the jib 18 to the drive control unit 702, the present invention is not limited thereto. The operation regulating unit 703 may output a signal for displaying predetermined warning information on the display unit 86 or a signal for ringing the notification buzzer 87 as the fall regulation signal without outputting the above-described signal to the drive control unit 702. In this case, the overturning of the crane 1 can be prevented by limiting manipulation of the boom 16 and the jib 18 by the worker in the cab 5 upon receiving the warning.

(2) Additionally, although the above embodiment has been described with respect to the mode in which, in the fall operation of the crane 1, where the boom 16 and the jib 18 fall from the work posture in FIG. 1, the mode of the operation regulating unit 703 is shifted from the disassembling mode to the self-erecting and falling mode, the present invention is not limited thereto. At the work posture in FIG. 1, the mode of the operation regulating unit 703 can be shifted from the ordinary work mode to the self-erecting and falling mode. In this case, in a case where it is concerned that the crane 1 may overturn, shift to the self-erecting and falling mode is desirably limited. Specifically, in a case where the jib boom angle condition is not established in the ordinary work mode, the operation regulating unit 703 can output, to the mode switching unit 701, a mode regulation signal for regulating switching from the ordinary work mode to the self-erecting and falling mode (the fall allowed mode). Such a configuration enables shift from the ordinary work mode to the self-erecting and falling mode to be prevented while keeping a posture at which the overturning of the crane 1 is feared.

(3) Additionally, in the above-described embodiment, although the description has been made of the mode in which the crane 1 can take the STD-LF mode shown in FIG. 1 and the SHL-LF mode shown in FIG. 2, the present invention is not limited thereto. In FIG. 2, an HL-LF mode (a heavy lift mode) may be adopted in which the crane 1B is not provided with the weight guy link 95 and the palette weight 96. Additionally, the crane 1 is not limited to one that can be changed into a plurality of modes as shown in FIG. 1 and FIG. 2, but may take one mode.

(4) Additionally, although the above embodiment has been described with respect to the mode in which the offset limit angle θs is set as a fixed value according to the specification of the crane 1 (lengths of the boom 16 and the jib 18, and weights of the counterweight 13 and the palette weight 96), the offset limit angle θs can be stored in the storage unit 706 as a variable for the ground angle θb of the boom 16 or the ground angle θj of the jib 18. In this case, an optimum offset limit angle θs is applied according to postures (ground angles) of the boom 16 and the jib 18, thereby preventing the crane 1 from overturning. In other words, in a case where the crane 1 is at a posture at which the crane is relatively unlikely to overturn, excessive limiting of the operations of the boom 16 and the jib 18 can be prevented.

(5) Additionally, although the above embodiment has been described with respect to the mode in which determination whether or not the front end portion (the wheel 65S) of the jib 18 is in contact with the ground is made based on the magnitude of the tension Tm of the jib guy link 28, the present invention is not limited thereto. The above-described contact state may be determined based on a rotation torque (a load of a roller) of the wheel 65S, a limit switch, video information acquired by a camera arranged near the wheel 65S, or the like.

(6) Additionally, although the above embodiment has been described with respect to the mode in which whether the jib boom angle condition is established or not is determined by comparing the jib offset angle θm and the offset limit angle θs, the present invention is not limited thereto. The opening angle between the boom 16 and the jib 18 (the exterior angle in a case where the jib offset angle θm is set to be the interior angle) may be compared with an opening threshold value angle formed of an obtuse angle set in advance. In this case, when the opening angle becomes larger than the opening threshold value angle, the determination unit 705 determines that the jib boom angle condition is not established.

(7) Although the present invention relates to limiting at least one operation of the fall operation and the self-erecting operation, and limiting both the fall operation and the self-erecting operation is not essential, in a case of limiting the self-erecting operation, the above-described "contact determination condition" for the limitation can be arbitrarily set. In the above-described embodiment, the following is set as the contact determination condition: the magnitude of the tension Tm of the jib guy link 28 is equal to or less than a fixed value, i.e., such a floating force, which causes the front end portion of the jib 18 to float from the ground against the self-weight of the jib or the like, is not practically acting. However, the contact determination condition may be a condition for determining whether or not the front end portion of the jib 18 is actually in contact with the ground. For example, the determination may be made whether or not the front end portion of the jib 18 is in contact with the ground based on a rotation torque (a load of a roller) of the wheel 65S, a limit switch, video information acquired by a camera arranged near the wheel 65S, or the like.

Additionally, in a mode where the contact determination condition is set based on the tension Tm of the jib guy link 28, a tension threshold value for the determination can be freely set. For example, the threshold value may be set not to a value corresponding to a state, as in the above embodiment, where the jib front end portion is completely floating above the ground but to a smaller value, i.e. a value corresponding to a state where although the jib front end portion is actually in contact with the ground, a floating force of more than a fixed magnitude is acting, the force having a possibility of floating the jib front end portion from the ground. In other words, "the predetermined contact determination condition for determining whether or not the front end portion of the jib is normally in contact with the ground" in the present invention may be a condition for determining whether or not the front end portion of the jib is actually in contact with the ground, or as "the normal contact", a condition may be used that not only the front end portion of the jib is actually in contact with the ground but also a contact pressure thereof has a sufficient magnitude, i.e., that a floating force having a possibility of floating the front end portion from the ground is not acting.

The present invention provides a crane including: a crane main body; a boom supported by the crane main body so as to be swingable around a horizontal first rotation axis; a jib having a base end portion supported at a front end portion of the boom so as to be swingable around a second rotation axis parallel to the first rotation axis and a front end portion on a side opposite to the base end portion; a boom driving unit which causes the boom to swing in a rise direction and a fall direction around the first rotation axis; a jib driving unit which causes the jib to swing in the rise direction and the fall direction around the second rotation axis; a manipulation unit which accepts manipulation for driving the boom and the jib; a drive control unit which outputs a drive signal for controlling the boom driving unit and the jib driving unit according to the manipulation input to the manipulation unit; a suspension device which is suspended from the front end portion of the jib and connected to a suspended load; an angle condition determination unit which determines whether a jib boom angle condition is established or not, the jib boom angle condition being established in a case where a jib offset angle as an angle defined by an extension of a center line of the boom and a center line of the jib when viewed from a direction parallel to the second rotation axis is larger than a threshold value angle formed of an acute angle set in advance; and an operation regulating unit which regulates swinging of the boom and the jib according to a mode set in advance, the operation regulating unit having an ordinary work mode and a self-erecting and falling mode, and regulating, in the ordinary work mode, swinging of the boom and the jib so that the front end portion of the jib is included in a work allowable range at a work posture of the crane at which the boom rises with respect to the crane main body and the jib rises with respect to the boom, the work allowable range being set according to a weight of the suspended load, and allowing, in the self-erecting and falling mode, the front end portion of the jib to enter an outside of the work allowable range irrespective of the weight of the suspended load, as well as allowing the crane to change a posture between a fall posture, at which the boom and the jib fall forward of the work posture and the front end portion of the jib lands on the ground, and the work posture according to a determination result of the angle condition determination unit.

Desirably, in the above-described configuration, the operation regulating unit allows the crane to change a posture from the work posture to the fall posture in the self-erecting and falling mode, and when the angle condition determination unit determines that the jib boom angle condition is not established, the operation regulating unit allows swinging of the jib in the fall direction, and regulates swinging of the boom in the rise direction and the fall direction and swinging of the jib in the rise direction irrespective of the drive signal, while when the angle condition determination unit determines that the jib boom angle condition is established, the operation regulating unit allows swinging of the boom in the rise direction and the fall direction and swinging of the jib in the rise direction and the fall direction.

The above-described configuration desirably further includes a cab arranged in the crane main body to allow a worker who manipulates the crane to board; and a display unit arranged in the cab to display predetermined work information, in which the operation regulating unit outputs a signal for displaying predetermined warning information on the display unit when, in the self-erecting and falling mode, the angle condition determination unit determines that the jib boom angle condition is not established.

Desirably in the above-described configuration, when, in the ordinary work mode, the angle condition determination unit determines that the jib boom angle condition is not established, the operation regulating unit regulates switching from the ordinary work mode to the self-erecting and falling mode.

The above-described configuration desirably further includes a jib contact state determination unit which determines whether or not a state of the jib satisfies a predetermined contact determination condition for determining whether the front end portion of the jib is normally in contact with the ground, in which the operation regulating unit allows, in the self-erecting and falling mode, the crane to change a posture from the fall posture to the work posture, the operation regulating unit allows the boom to swing in the rise direction and the fall direction and the jib to swing in the rise direction and the fall direction only when the jib contact state determination unit determines that the state of the jib satisfies the contact determination condition in a case where the angle condition determination unit determines that the jib boom angle condition is not established, while in a case where the jib contact state determination unit determines that the state of the jib does not satisfy the contact determination condition, allowing the jib to swing in the fall direction, as well as regulating the swinging of the boom in the rise direction and the fall direction and the swinging of the jib in the rise direction irrespective of the drive signal, and the operation regulating unit allows the swinging of the boom in the rise direction and the fall direction and the swinging of the jib in the rise direction and the fall direction irrespective of a determination result of the jib contact state determination unit in a case where the angle condition determination unit determines that the jib boom angle condition is established.

The above-described configuration desirably further includes a jib raising and lowering rope connected to the front end of the jib, and a tension detection unit which detects a tension of the jib raising and lowering rope, in which the jib contact state determination unit determines that the contact determination condition is satisfied in a case where the tension detected by the tension detection unit is equal to or less than a threshold value tension set in advance.

The above-described configuration desirably further includes a cab arranged in the crane main body to allow a worker who manipulates the crane to board; and a display unit arranged in the cab to display predetermined work information, in which the operation regulating unit outputs a signal for displaying predetermined warning information on the display unit when, in the self-erecting and falling mode, the angle condition determination unit determines that the jib boom angle condition is not established and the jib contact state determination unit determines that the contact determination condition is not established.

The above-described configuration desirably further includes a boom angle detection unit which detects a ground angle of the boom; a jib angle detection unit which detects a ground angle of the jib; an angle decision unit which decides the jib offset angle from the ground angle of the boom detected by the boom angle detection unit and the ground angle of the jib detected by the jib angle detection unit; and a storage unit which stores the threshold value angle in advance and is capable of outputting the threshold value angle, in which the angle condition determination unit determines that the jib boom angle condition is established in a case where the jib offset angle decided by the angle decision unit is larger than the threshold value angle output from the storage unit.

The above-described configuration desirably further includes an input unit which accepts length information related to a length of the jib and a length of the boom, in which the storage unit stores a plurality of the threshold value angles according to a combination of the length of the jib and the length of the boom and outputs a predetermined threshold value angle from among the plurality of threshold value angles according to the length information input to the input unit.

The above-described configuration desirably further includes a weight body which is arranged at a rear side portion of the crane main body or arranged more to the rear side than the crane main body and which keeps balance of the crane, in which the input unit is further capable of accepting weight information related to a weight of the weight body, and the storage unit stores a plurality of the threshold value angles according to a combination of the length of the jib, the length of the boom, and the weight of the weight body, and outputs a predetermined threshold value angle from among the plurality of threshold value angles according to the length information and the weight information input to the input unit.

The present invention provides a posture changing method of a crane which includes a crane main body; a boom supported by the crane main body so as to be swingable around a horizontal first rotation axis; a jib having a base end portion supported at a front end portion of the boom so as to be swingable around a second rotation axis parallel to the first rotation axis and a front end portion on a side opposite to the base end portion; and a manipulation unit which accepts manipulation for driving the boom and the jib. The posture changing method of the crane, aiming at regulating swinging of the boom and the jib according to an ordinary work mode and a self-erecting and falling mode set in advance, includes, in the ordinary work mode, regulating swinging of the boom and the jib so that the front end portion of the jib is included in a work allowable range at a work posture of the crane at which the boom rises with respect to the crane main body and the jib rises with respect to the boom, the work allowable range being set according to a weight of a suspended load, and allowing, in the self-erecting and falling mode, the front end portion of the jib to enter an outside of the work allowable range irrespective of the weight of the suspended load, as well as allowing the crane to change a posture between a fall posture, at which the boom and the jib fall forward of the work posture and the front end portion of the jib lands on the ground, and the work posture according to establishment of a jib boom angle condition which is established when a jib offset angle as an angle defined by an extension of a center line of the boom and a center line of the jib when viewed from a direction parallel to the second rotation axis is larger than a threshold value angle set in advance.

The above-described method desirably includes, in a case where the jib boom angle condition is not established in the self-erecting and falling mode, allowing swinging of the jib in a fall direction of the jib, and regulating swinging of the boom in a rise direction and the fall direction and swinging of the jib in the rise direction irrespective of manipulation accepted by the manipulation unit, and in a case where the jib boom angle condition is established in the self-erecting and falling mode, while allowing swinging of the boom in the rise direction and the fall direction and swinging of the jib in the rise direction and the fall direction, changing a posture of the crane from the work posture to the fall posture.

Additionally, the above-described method desirably includes, in a case where, in the self-erecting and falling mode, the jib boom angle condition is not established and a state of the jib does not satisfy a predetermined contact determination condition for determining whether or not the front end portion of the jib is normally in contact with the ground, allowing swinging of the jib in the fall direction, and regulating swinging of the boom in the rise direction and the fall direction and swinging of the jib in the rise direction irrespective of manipulation accepted by the manipulation unit, and in a case where at least the jib boom angle condition is established or the contact determination condition is satisfied in the self-erecting and falling mode, while allowing swinging of the boom in the rise direction and the fall direction and swinging of the jib in the rise direction and the fall direction, changing a posture of the crane from the fall posture to the work posture.

The invention claimed is:

1. A crane, comprising:

a crane main body;

a boom supported by the crane main body so as to be swingable around a horizontal first rotation axis;

a jib having a base end portion supported at a front end portion of the boom so as to be swingable around a second rotation axis parallel to the first rotation axis and a front end portion on a side opposite to the base end portion;

a boom driving unit configured to swing the boom in a rise direction and a fall direction around the first rotation axis;

a jib driving unit configured to swing the jib in the rise direction and the fall direction around the second rotation axis;

a manipulation unit configured to accept manipulation for driving the boom and the jib;

a drive control unit configured to output a drive signal for controlling the boom driving unit and the jib driving unit according to a manipulation input to the manipulation unit;

a suspension device suspended from the front end portion of the jib and configured to be connected to a suspended load;

an angle condition determination unit configured to determine whether a jib boom angle condition is established or not, the jib boom angle condition being established in a case where a jib offset angle as an angle defined by an extension of a center line of the boom and a center line of the jib when viewed from a direction parallel to the second rotation axis is larger than a threshold angle formed of an acute angle set in advance; and an operation regulating unit configured to regulate swinging of the boom and the jib according to a mode set in advance, the operation regulating unit having an ordinary work mode and a self-erecting and falling mode, and configured to regulate, in the ordinary work mode, swinging of the boom and the jib so that the front end portion of the jib is included in a work allowable range at a work posture of the crane at which the boom rises with respect to the crane main body and the jib rises with respect to the boom, the work allowable range being set according to a weight of the suspended load, and allowing, in the self-erecting and falling mode, the front end portion of the jib to enter an outside of the work allowable range irrespective of the weight of the suspended load, as well as allowing the crane to change a posture between a fall posture, at which the boom and the jib fall forward of the work posture and the front end portion of the jib lands on the ground, and the work posture according to a determination result of the angle condition determination unit.

2. The crane according to claim 1, wherein the operation regulating unit is configured to allow the crane to change a posture from the work posture to the fall posture in the self-erecting and falling mode, and when the angle condition determination unit determines that the jib boom angle condition is not established, the operation regulating unit allows swinging of the jib in the fall direction, and regulates swinging of the boom in the rise direction and the fall direction and swinging of the jib in the rise direction irrespective of the drive signal, while when the angle condition determination unit determines that the jib boom angle condition is established, the operation regulating unit allows swinging of the boom in the rise direction and the fall direction and swinging of the jib in the rise direction and the fall direction.

3. The crane according to claim 2, further comprising:

a cab arranged in the crane main body to allow a worker who manipulates the crane to board; and a display unit arranged in the cab to display predetermined work information, wherein the operation regulating unit is configured to output a signal for displaying predetermined warning information on the display unit when, in the self-erecting and falling mode, the angle condition determination unit determines that the jib boom angle condition is not established.

4. The crane according to claim 1, wherein when, in the ordinary work mode, the angle condition determination unit determines that the jib boom angle condition is not established, the operation regulating unit regulates switching from the ordinary work mode to the self-erecting and falling mode.

5. The crane according to claim 1, further comprising:

a jib contact state determination unit which is configured to determine whether or not a state of the jib satisfies a predetermined contact determination condition for determining whether the front end portion of the jib is normally in contact with the ground, wherein the operation regulating unit is configured to allow, in the self-erecting and falling mode, the crane to change a posture from the fall posture to the work posture, the operation regulating unit is configured to allow the boom to swing in the rise direction and the fall direction and the jib to swing in the rise direction and the fall direction only when the jib contact state determination unit determines that the state of the jib satisfies the contact determination condition in a case where the angle condition determination unit determines that the jib boom angle condition is not established, while in a case where the jib contact state determination unit determines that the state of the jib does not satisfy the contact determination condition, allowing the jib to swing in the fall direction, as well as regulating the swinging of the boom in the rise direction and the fall direction and the swinging of the jib in the rise direction irrespective of the drive signal, and the operation regulating unit is configured to allow the swinging of the boom in the rise direction and the fall direction and the swinging of the jib in the rise direction and the fall direction irrespective of a determination result of the jib contact state determination unit in a case where the angle condition determination unit determines that the jib boom angle condition is established.

6. The crane according to claim 5, further comprising:

a jib raising and lowering rope connected to the front end of the jib, and a tension detection unit configured to detect a tension of the jib raising and lowering rope, wherein the jib contact state determination unit is configured to determine that the contact determination condition is satisfied in a case where the tension detected by the tension detection unit is equal to or less than a threshold value tension set in advance.

7. The crane according to claim 5, further comprising:

a cab arranged in the crane main body to allow a worker who manipulates the crane to board; and a display unit arranged in the cab to display predetermined work information, wherein the operation regulating unit is configured to output a signal for displaying predetermined warning information on the display unit when, in the self-erecting and falling mode, the angle condition determination unit determines that the jib boom angle condition is not established and the jib contact state determination unit determines that the contact determination condition is not established.

8. The crane according to claim 1, further comprising:

a boom angle detection unit configured to detect a ground angle of the boom;

a jib angle detection unit configured to detect a ground angle of the jib;

an angle decision unit configured to decide the jib offset angle from the ground angle of the boom detected by the boom angle detection unit and the ground angle of the jib detected by the jib angle detection unit; and a storage unit configured to store the threshold angle in advance and configured to output the threshold angle, wherein the angle condition determination unit is configured to determine that the jib boom angle condition is established in a case where the jib offset angle decided by the angle decision unit is larger than the threshold angle output from the storage unit.

9. The crane according to claim 8, further comprising:

an input unit configured to accept length information related to a length of the jib and a length of the boom, wherein the storage unit is configured to store a plurality of threshold angles according to a combination of the length of the jib and the length of the boom and output a predetermined threshold angle from among the plurality of the threshold angles according to the length information input to the input unit.

10. The crane according to claim 9, further comprising:

a weight body which is at least one of arranged at a rear side portion of the crane main body and arranged more to the rear side than the crane main body and which keeps balance of the crane, wherein the input unit is further configured to accept weight information related to a weight of the weight body, and the storage unit is configured to store the plurality of threshold angles according to a combination of the length of the jib, the length of the boom, and the weight of the weight body, and output a predetermined threshold angle from among the plurality of the threshold angles according to the length information and the weight information input to the input unit.

11. A posture changing method of a crane which includes a crane main body; a boom supported by the crane main body so as to be swingable around a horizontal first rotation axis; a jib having a base end portion supported at a front end portion of the boom so as to be swingable around a second rotation axis parallel to the first rotation axis and a front end portion on a side opposite to the base end portion; and a manipulation unit configured to accept manipulation for driving the boom and the jib, the method, including an ordinary work mode and a self-erecting and falling mode set in advance, comprising:

in the ordinary work mode, regulating swinging of the boom and the jib so that the front end portion of the jib is included in a work allowable range at a work posture of the crane at which the boom rises with respect to the crane main body and the jib rises with respect to the boom, the work allowable range being set according to a weight of a suspended load, and allowing, in the self-erecting and falling mode, the front end portion of the jib to enter an outside of the work allowable range irrespective of the weight of the suspended load, as well as allowing the crane to change a posture between a fall posture, at which the boom and the jib fall forward of the work posture and the front end portion of the jib lands on the ground, and the work posture according to establishment of a jib boom angle condition when a jib offset angle as an angle defined by an extension of a center line of the boom and a center line of the jib when viewed from a direction parallel to the second rotation axis is larger than a threshold angle set in advance.

12. The posture changing method of a crane according to claim 11, comprising:

in a case where the jib boom angle condition is not established in the self-erecting and falling mode, allowing swinging of the jib in a fall direction of the jib, and regulating swinging of the boom in a rise direction and the fall direction and swinging of the jib in the rise direction irrespective of manipulation accepted by the manipulation unit, and in a case where the jib boom angle condition is established in the self-erecting and falling mode, while allowing swinging of the boom in the rise direction and the fall direction and swinging of the jib in the rise direction and the fall direction, changing a posture of the crane from the work posture to the fall posture.

13. The posture changing method of a crane according to claim 11, comprising:

in a case where, in the self-erecting and falling mode, the jib boom angle condition is not established and a state of the jib does not satisfy a predetermined contact determination condition for determining whether or not the front end portion of the jib is normally in contact with the ground, allowing swinging of the jib in the fall direction, and regulating swinging of the boom in the rise direction and the fall direction and swinging of the jib in the rise direction irrespective of manipulation accepted by the manipulation unit, and in a case where at least one of the jib boom angle condition is established and the contact determination condition is satisfied in the self-erecting and falling mode, while allowing swinging of the boom in the rise direction and the fall direction and swinging of the jib in the rise direction and the fall direction, changing a posture of the crane from the fall posture to the work posture.

* * * * *